US012679585B2

(12) United States Patent
Langen

(10) Patent No.: US 12,679,585 B2
(45) Date of Patent: Jul. 14, 2026

(54) LOADING CASES WITH ITEMS

(71) Applicant: AFA SYSTEMS LTD., Brampton (CA)

(72) Inventor: H. J. Paul Langen, Brampton (CA)

(73) Assignee: AFA SYSTEMS LTD., Brampton (CA)

( * ) Notice: Subject to any disclaimer, the term of this patent is extended or adjusted under 35 U.S.C. 154(b) by 0 days.

(21) Appl. No.: 18/780,005

(22) Filed: Jul. 22, 2024

(65) Prior Publication Data

US 2025/0121972 A1 Apr. 17, 2025

Related U.S. Application Data

(63) Continuation of application No. 18/092,022, filed on Dec. 30, 2022, now abandoned.

(51) Int. Cl.

| | |
|---|---|
| ***B65B 43/10*** | (2006.01) |
| ***B65B 35/30*** | (2006.01) |
| ***B65B 43/59*** | (2006.01) |

(52) U.S. Cl.

CPC ..... *B65B 43/59* (2013.01); *B65B 35/30* (2013.01); *B65B 43/10* (2013.01)

(58) Field of Classification Search

CPC ..... B65B 43/10; B65B 5/06; B65B 43/265; B65B 21/242; B65B 35/30; B65B 43/59; B65B 39/12; B65B 35/42

USPC ..... 53/564

See application file for complete search history.

(56) References Cited

U.S. PATENT DOCUMENTS

| | | | |
|---|---|---|---|
| 2,549,800 | A | 4/1951 | George |
| 2,706,935 | A | 4/1955 | Pasjack |
| 2,786,316 | A | 3/1957 | Silva et al. |
| 2,869,297 | A | 1/1959 | Neer |
| 2,879,638 | A | 3/1959 | Hill |
| 2,902,810 | A | 9/1959 | McGihon |
| 3,619,967 | A | 11/1971 | Alduk |
| 3,626,661 | A | 12/1971 | Reichert et al. |

(Continued)

FOREIGN PATENT DOCUMENTS

| | | | |
|---|---|---|---|
| CA | 2700657 | C | 11/2007 |
| JP | 5943401 | B1 | 7/2016 |

(Continued)

OTHER PUBLICATIONS

International Search Report and Written Opinion of the International Searching Authority issued by the Canadian Intellectual Property Office on May 16, 2022, in connection with International Patent Application No. PCT/CA2022/050198, 11 pages.

(Continued)

*Primary Examiner* — Chinyere J Rushing-Tucker

(57) ABSTRACT

A system is disclosed for loading cases with items. An item delivery apparatus delivers a plurality of items to a location for collating the items on a collation platform. A transfer apparatus transfers a plurality of items from the collation platform to a pedestal, where the plurality of items are surrounded, on three sides, by a fence. A case movement apparatus, such as a cartesian robot moves an erected case blank in a path that sheaths, with the erected case blank, a group of items located on the pedestal. As the case blank is dropped vertically downward to sheath the group of items, the fence is moved vertically downward and out of the way of further processing of the, now loaded, case blank.

7 Claims, 17 Drawing Sheets

(56) References Cited

U.S. PATENT DOCUMENTS

| | | | |
|---|---|---|---|
| 3,698,151 | A | 10/1972 | Arneson |
| 3,757,486 | A | 9/1973 | Feurston et al. |
| 3,803,993 | A | 4/1974 | Graham |
| 3,843,039 | A | 10/1974 | Brown et al. |
| 3,930,438 | A | 1/1976 | Hackman et al. |
| 3,940,907 | A | 3/1976 | Ganz |
| 4,010,593 | A | 3/1977 | Graham |
| 4,570,421 | A | 2/1986 | Focke et al. |
| 4,674,261 | A | 6/1987 | Sabel |
| 4,763,462 | A | 8/1988 | Johnson, Jr. et al. |
| 4,802,324 | A | 2/1989 | Everson |
| 4,942,720 | A | 7/1990 | Berney |
| 4,962,625 | A | 10/1990 | Johnson, Jr. et al. |
| 5,042,233 | A | 8/1991 | Huang et al. |
| 5,105,600 | A | 4/1992 | DePoint, Jr. et al. |
| 5,115,625 | A | 5/1992 | Barbulesco et al. |
| 5,600,936 | A | 2/1997 | Moncrief et al. |
| 5,626,002 | A | 5/1997 | Ford et al. |
| 5,720,156 | A | 2/1998 | Bridges et al. |
| 5,727,365 | A | 3/1998 | Lashyro et al. |
| 5,782,064 | A | 7/1998 | Beeman |
| 6,128,886 | A | 10/2000 | Johnson, Jr. et al. |
| 6,968,668 | B1 | 11/2005 | Dimario et al. |
| 7,073,705 | B2 | 7/2006 | Auclair et al. |
| 7,093,408 | B2 | 8/2006 | Duperray et al. |
| 7,302,785 | B2 | 12/2007 | Heuvel et al. |
| 7,758,292 | B2 | 7/2010 | Close et al. |
| 8,621,831 | B2 | 1/2014 | Moylan et al. |
| 9,718,570 | B1 | 8/2017 | Ortiz et al. |
| 11,505,341 | B1 | 11/2022 | Danner, Jr. et al. |
| 2003/0183484 | A1 | 10/2003 | Peterman et al. |
| 2003/0222129 | A1 | 12/2003 | Williams |
| 2006/0042188 | A1 | 3/2006 | Ford |
| 2006/0117716 | A1 | 6/2006 | Bonnain et al. |
| 2007/0204567 | A1 | 9/2007 | Wintring et al. |
| 2008/0116085 | A1 | 5/2008 | Aris et al. |
| 2010/0170201 | A1 | 7/2010 | Aquarius |
| 2011/0030318 | A1 | 2/2011 | Moylan et al. |
| 2011/0154784 | A1 | 6/2011 | Poutot |
| 2011/0272458 | A1 | 11/2011 | Hardy |
| 2012/0006651 | A1 | 1/2012 | Cote |
| 2012/0096808 | A1 | 4/2012 | Poutot et al. |
| 2014/0179501 | A1 | 6/2014 | Akama et al. |
| 2015/0329231 | A1 | 11/2015 | Moncrief et al. |
| 2016/0229571 | A1* | 8/2016 | Hansen ..... B31B 50/07 |
| 2017/0101200 | A1 | 4/2017 | Anderson et al. |
| 2018/0126683 | A1 | 5/2018 | Johnson |
| 2019/0062074 | A1 | 2/2019 | Johnson et al. |
| 2019/0233151 | A1 | 8/2019 | Ford et al. |
| 2019/0248522 | A1 | 8/2019 | Prinz et al. |
| 2019/0263545 | A1* | 8/2019 | Yokota ..... B31B 50/064 |
| 2019/0389611 | A1 | 12/2019 | Pettersson |
| 2021/0138756 | A1* | 5/2021 | Langen ..... B31B 50/262 |
| 2022/0161445 | A1 | 5/2022 | Larouche et al. |
| 2022/0258894 | A1 | 8/2022 | Langen et al. |
| 2023/0226792 | A1 | 7/2023 | Iwasa et al. |

FOREIGN PATENT DOCUMENTS

| | | | |
|---|---|---|---|
| JP | 2018-154345 | A | 10/2018 |
| JP | 2020-142844 | A | 9/2020 |
| WO | 96/32322 | A1 | 10/1996 |
| WO | 2015/039669 | A1 | 3/2015 |

OTHER PUBLICATIONS

Non-Final Office Action mailed by the USPTO on May 10, 2023, in the related U.S. Appl. No. 17/186,618.

Final Office Action mailed by the USPTO on Jan. 5, 2024, in the related U.S. Appl. No. 17/186,618.

Non-Final Office Action mailed by the USPTO on Oct. 5, 2023, in the related U.S. Appl. No. 18/092,022.

Non-Final Office Action mailed by the USPTO on Nov. 5, 2024, in the related U.S. Appl. No. 17/186,618.

* cited by examiner

LOADING CASES WITH ITEMS

CROSS-REFERENCE TO RELATED APPLICATION

This application is a Continuation of U.S. patent application Ser. No. 18/092,022, filed on Dec. 30, 2022, the contents of which are incorporated herein by reference.

TECHNICAL FIELD

The present disclosure relates, generally, to packaging and, in particular embodiments, to loading cases with items.

BACKGROUND

Containers are used to package many different kinds of items. One form of container used in the packaging industry is what is known generically as a "box" and it can be used to hold various "items." Items may be defined to include individual products and to include other boxes containing products. Some in the packaging industry refer to boxes used to package one or more products as "cartons." Also, there are containers/boxes that are known, by some, as "cases." Examples of cases include what are known as regular slotted cases ("RSC"). In present application, including in the claims, the words "cases," "cartons" and "containers" are used collectively and interchangeably to refer to boxes, cartons and/or cases that can be used to package items.

Cases come in many different configurations and are made from a wide variety of materials. However, many cases are foldable and are formed from a flattened state—commonly called a "case blank." Cases may be made from an assortment of foldable materials, including, but not limited to, cardboard, chipboard, paperboard, corrugated fibreboard, other types of corrugated materials, plastic materials, composite materials and the like and, possibly, even combinations thereof.

In many known systems, case blanks may be serially retrieved, from a magazine, reconfigured, from a flattened state into an erected state, and then placed in a slot on a conveyor. The case blank in the erected state may be moved by the conveyor to a loading station where the case blank in the erected state may be filled with one or more items and then sealed.

To permit the case blanks to be readily opened up into the erected state from the flattened state, the case blanks may be held in the magazine in a generally completely flattened configuration. The case blanks may then be folded and sealed, such as by gluing or taping panels and/or flaps together, to form an erected case blank. Specialized apparatus that can handle only flat, unfolded and unsealed case blanks are known.

Some case blanks are provided to users not in a flat, unfolded and unsealed form but, rather, in a form that is known as a "knock-down" blank or "KD blank." A KD blank may be provided in a folded and flattened configuration and may be partially glued or otherwise partially sealed, such as along one side seam, thus being formed in a generally flattened tubular shape. Accordingly, each case blank may require opposite panels to be pulled apart and reconfigured from a flattened tubular configuration to an erected, open tubular or sleeve-like configuration that is suitable for delivery to another system such as a conveyor. The case blank may then have one side opening closed by folding and sealing the flaps and may then be filled from the opposite side with one or more items while on the conveyor (this scheme may be referred to as "side loading"). Also, any required additional flap folding and sealing, such as with glue or tape, can be carried out to enclose and completely close and seal the loaded case blank with the one or more items contained therein. Alternately, for example, an erected case blank can be reoriented from a side orientation to an upright orientation with the opening facing upwards and a having a sealed bottom end. The erected case blank can then be moved to a loading system where it may be filled from its top side with one or more items via an opening that is facing upwards (this scheme may be referred to as "top loading"). The one or more items may be top loaded using, at least in part, gravity to "drop" the one or more items into the erected, bottom sealed case blank. The top opening of the case blank can then be closed by folding over and sealing the top flaps.

However, in some situations, it is not desirable to top load or side load items into an erected carton/case. For example, top loading and side loading may be considered undesirable in situations wherein the size and shape of items to be loaded are narrow or tapered on the top and sides. This can present a challenge for the automated loading of items. For example, an electromechanical system may have challenges to lift and adjust a group of several items as a result of the shape of the items. Also, top loading items into a tightly fitting interior space area of an open top case blank can be challenging. Furthermore, some items, such as glass or plastic bottles, are particularly susceptible to being damaged or broken when being top loaded into an erected carton/case, particularly when they are "drop packed" into an erected case blank.

SUMMARY

A system is disclosed for loading cases with items. An item delivery apparatus delivers a plurality of items to a location for collating the items on a collation platform. A transfer apparatus transfers a plurality of items from the collation platform to a pedestal, where the plurality of items are surrounded, on three sides, by a fence. A case movement apparatus, such as a cartesian robot moves an erected case blank in a path that sheaths, with the erected case blank, a group of items located on the pedestal. As the case blank is dropped vertically downward to sheath the group of items, the fence is moved vertically downward and out of the way of further processing of the, now loaded, case blank.

According to an aspect of the present disclosure, there is provided a system for loading cases with items. The system includes an item delivery apparatus operable to deliver a plurality of items to a transfer station, a collation platform operable to support a group of items, a pedestal operable to support the group of items and a transfer apparatus. The transfer apparatus is operable to transfer a plurality of items from the item delivery apparatus at the transfer station, to the collation platform, to form the group of items on the collation platform and transfer the group of items from the collation platform to the pedestal. The system further includes a fence and a fence support apparatus, wherein the fence is arranged to surround, on three sides, the group of items on the pedestal and a case movement apparatus located proximate the pedestal apparatus, the case movement apparatus operable to move an erected case blank in a path that sheaths, with an erected case blank, a group of items located on the pedestal. In operation, the item delivery apparatus delivers a plurality of items to the transfer station, the transfer apparatus transfers a plurality of items from the item delivery apparatus at the transfer station, to the collation platform, to form a group of items on the collation platform, the transfer apparatus transfers the group of items from the collation platform to the pedestal, the case movement apparatus moves the erected case blank to sheath the group of items located on the pedestal and the fence support apparatus moves the fence vertically downward while the case movement apparatus moves the erected case blank to sheath the group of items.

Other aspects and features will become apparent to those of ordinary skill in the art upon review of the following description of specific embodiments of the invention in conjunction with the accompanying figures.

BRIEF DESCRIPTION OF THE DRAWINGS

For a more complete understanding of the present embodiments, and the advantages thereof, reference is now made, by way of example, to the following descriptions taken in conjunction with the accompanying drawings, in which.

DETAILED DESCRIPTION

For illustrative purposes, specific example embodiments will now be explained in greater detail in conjunction with the figures.

The embodiments set forth herein represent information sufficient to practice the claimed subject matter and illustrate ways of practicing such subject matter. Upon reading the following description in light of the accompanying figures, those of skill in the art will understand the concepts of the claimed subject matter and will recognize applications of these concepts not particularly addressed herein. It should be understood that these concepts and applications fall within the scope of the disclosure and the accompanying claims.

Moreover, it will be appreciated that any module, component, or device disclosed herein that executes instructions may include, or otherwise have access to, a non-transitory computer/processor readable storage medium or media for storage of information, such as computer/processor readable instructions, data structures, program modules and/or other data. A non-exhaustive list of examples of non-transitory computer/processor readable storage media includes magnetic cassettes, magnetic tape, magnetic disk storage or other magnetic storage devices, optical disks such as compact disc read-only memory (CD-ROM), digital video discs or digital versatile discs (i.e., DVDs), Blu-ray Disc™, or other optical storage, volatile and non-volatile, removable and non-removable media implemented in any method or technology, random-access memory (RAM), read-only memory (ROM), electrically erasable programmable read-only memory (EEPROM), flash memory or other memory technology. Any such non-transitory computer/processor storage media may be part of a device or accessible or connectable thereto. Computer/processor readable/executable instructions to implement an application or module described herein may be stored or otherwise held by such non-transitory computer/processor readable storage media.

In some packaging situations, it may be desirable to be able "bottom load" a carton/case. In a bottom loading operation, there is relative upward movement of one or more items through a case opening that is oriented/facing in a downward direction. However, there are significant challenges in bottom loading of case, such as, for example, the difficulty of closing the bottom flaps when items are otherwise supported within the interior storage space of an erected carton/case.

Figure 1:
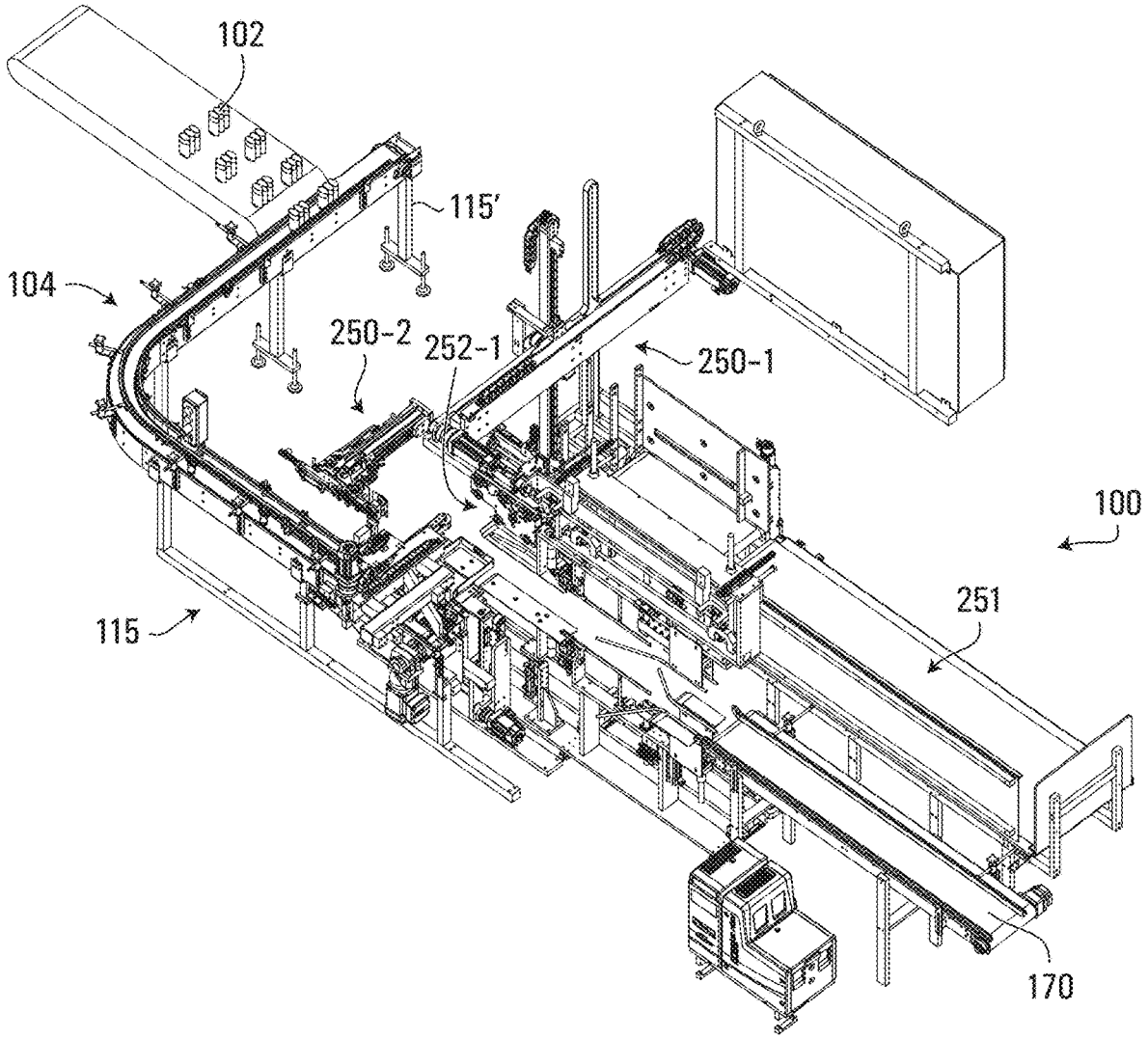
FIG. 1 illustrates, in a front-right-upper perspective view, a system for loading erected case blanks with one or more items and closing and sealing the top and bottom ends of loaded case blanks, in accordance with aspects of the present application.

With reference to FIG. 1, in overview, a system 100 operable for loading a plurality of items 102 (referenced collectively or individually by reference numeral 102) into cases formed from selected ones of a plurality of case blanks is illustrated. Individual items among the plurality of items 102 may be singular units of a manufactured product, which may be delivered to the system 100 from a separate manufacturing facility or from another source. The items 102 may feature a rigid body, which rigid body may have an interior cavity that may hold a substance. For example, the individual items 102 may be individual glass or plastic bottles containing a liquid such as a beverage (e.g., bottles of wine or beer) or individual bottles or other rigid containers holding another material or substance, such as a liquid, for example, laundry detergent. The items 102 may alternatively be paperboard or composite cartons (such as cartons of juice or milk) or metal, paperboard or composite cans of a product such as cans of a food or cans of spray paint. Each item 102 may be a rigid (or semi-rigid) item and may be an item for which there exists a desire to collate and/or bottom-load into an interior storage space 107 defined by interior surfaces of panels A-D of an erected case blank 111C (see FIG. 3C). Typically, each item 102 loaded into the erected case blank 111C using the system 100 will be stable and self-supporting, at least when formed into a collated group 122 (see FIG. 4) of items. Each item 102 may be self-supporting on a base portion. The plurality of items 102 may not be a type of container containing a substance but, rather, some other self-supporting rigid, or semi-rigid, item to be loaded into a case. In aspects of the present application, the items 102 may be self-supporting and stable only when formed into the collated group 122 of items.

Each item 102 among the plurality of items 102 may be configured with a base portion configured to support the item 102 in a generally vertically upright orientation. One example of such a base portion is a generally flat base support surface. Each item 102 may be shaped with a main lower body portion having an outer surface of a first cross-sectional size/diameter and an upper neck region having an outer surface of a smaller cross-sectional size/diameter; note that the shape of a typical wine bottle fits this description. By way of example only, each item 102 may be a 150 ml plastic or glass bottle with an upper cylindrical shorter neck region, a vertically extended generally cylindrical body portion and a bottle cap or other closure secured over a top opening in the neck region. The interior cavity of each item 102 may be occupied by a liquid, or a semi-liquid, product. Each item 102 may have a shoulder formed at the join between the body portion and the neck portion/closure.

Figure 3A:
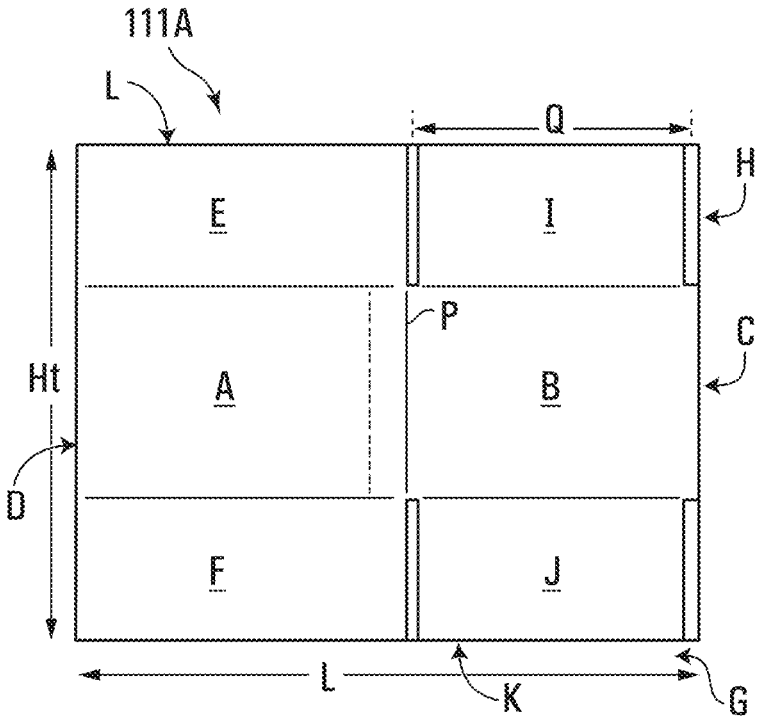
FIG. 3A illustrates, in a top view, an example non-erected case blank that can be used in the system of FIG. 1, in accordance with aspects of the present application.
Figure 3B:
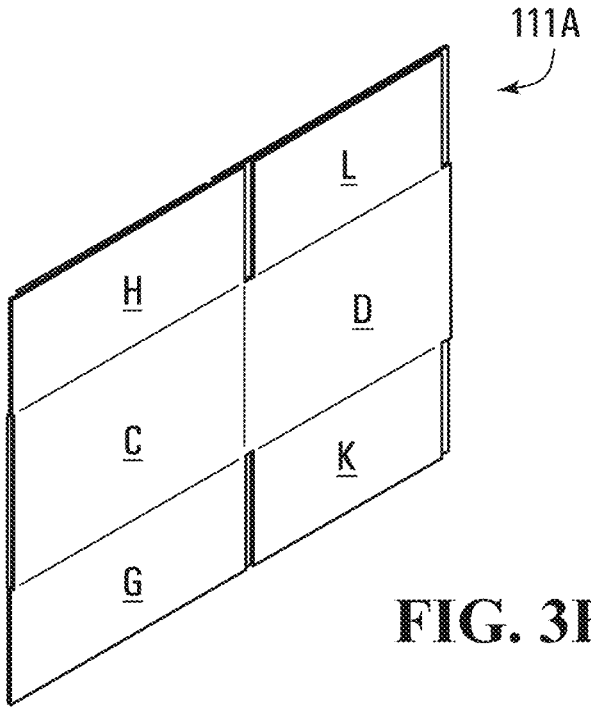
FIG. 3B illustrates, in a perspective view, the example non-erected case blank of FIG. 3A.
Figure 3C:
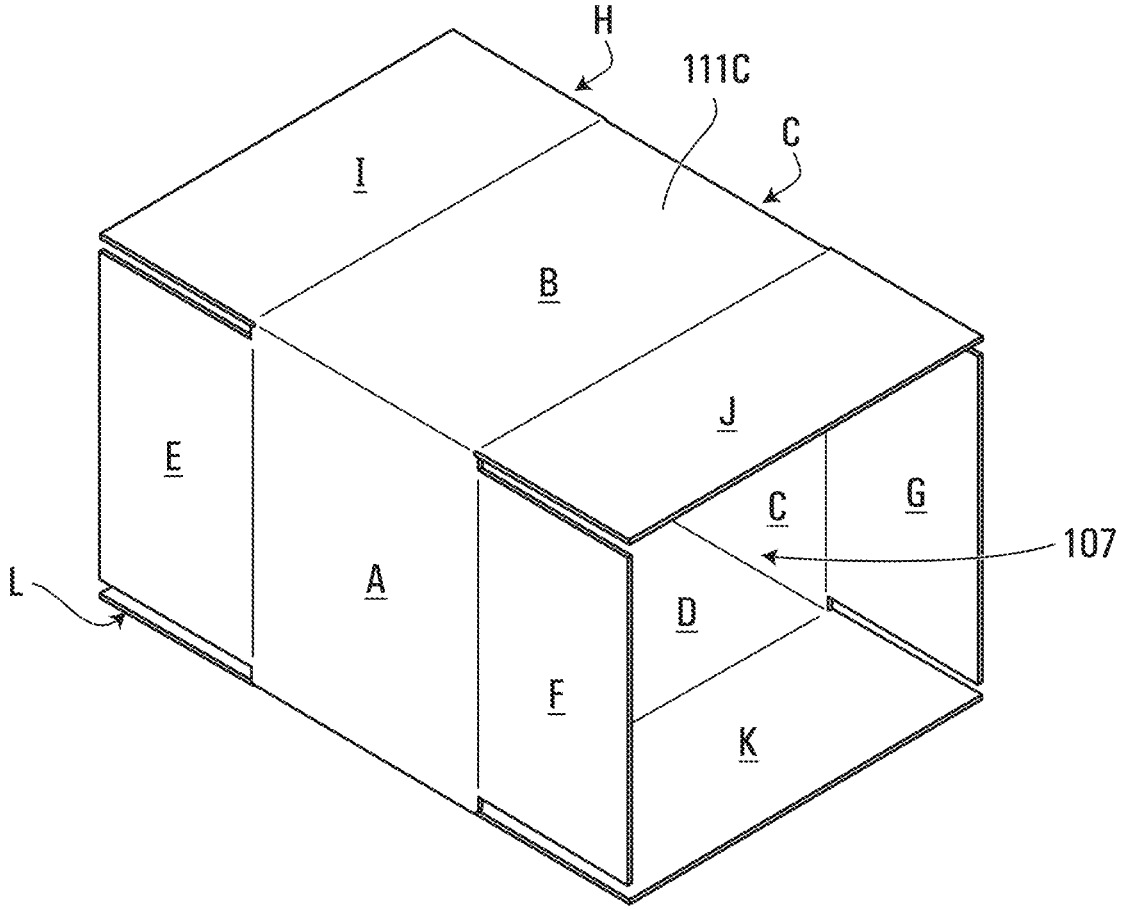
FIG. 3C illustrates, in a perspective view, the example non-erected case blank of FIG. 3A, in an erected configuration.

With reference to FIGS. 3A, 3B and 3C, each case blank 111A used in the system 100 of FIG. 1 may have opposed minor side panels A and C interconnected to a pair of opposed major side panels B and D that, together, form a tubular sleeve, illustrated in FIG. 3C, when the flat case blank 111A has been opened. An overlap strip of case blank material may be provided between panel B and panel A. The overlap strip may be sealed, by conventional means, such as a suitable adhesive, to provide an overlapping seam joint in the vicinity of "P" (see FIG. 3A). This seam joint forms a knock-down case blank in which the panels A, B, C and D are joined into the flat case blank 111A that is of generally flattened tubular configuration, as shown in FIGS. 3A and 3B.

Also, as shown in FIGS. 3A, 3B and 3C, the flat case blank 111A includes opposed pairs of end flaps E, H, L, I that are positioned at one end (e.g., the top end) of the respective side panels A, B, C, D. A second set of opposed pairs of end flaps F, G, K, J are positioned at the opposite end (e.g., the bottom end) of side panels A, B, C, D. However, in other aspects of the present application, case blanks having other panel and flap configurations are contemplated. The panels and flaps may be connected to adjacent flaps/panels by predetermined fold/crease lines, such as the fold/crease lines illustrated in FIGS. 3A and 3B. These fold/crease lines may, for one example, be formed by a weakened area of material and/or may, for another example, be formed using a crease forming apparatus. The effect of the fold/crease lines is that one panel, such as, for example, panel A, can be rotated relative to an adjacent panel such as, panel D or panel B, along the fold/crease lines. Flaps may also fold and rotate about fold/crease lines that connect the flaps to their respective panels.

The flat case blanks 111A may be made of any suitable material(s) configured and adapted to permit the required folding/bending/displacement of the material to reach the desired configuration. Examples of suitable materials are chipboard, cardboard or creased corrugated fiberboard. It should be noted that each flat case blank 111A may be formed of a material that, itself, is rigid or semi-rigid and not easily foldable but that is divided into separate panels and flaps separated by creases or hinge-type mechanisms, so that the flat case blank 111A can be erected and formed. In some aspects of the present application, the flat case blanks may be delivered to the system 100 of FIG. 1 in a form in which the case blank is already in a tubular shape and may be completely or partially sealed at an upper end, with the bottom end being open. In some aspects of the present application, each case blank may not be rectangular or square in horizontal section shape.

The system 100 of FIG. 1 may have a programmable logic controller ("PLC") 132 (see FIG. 2) for controlling various operational components of the system. The system 100 may also include a case movement and loading apparatus/subsystem (that may comprise a first cartesian robot 250-1, and a second cartesian robot 250-2), a blank magazine 251 and an item infeed conveyor 104. The blank magazine 251 may be configured to hold a plurality of vertically stacked, flat case blanks 111A.

Figure 5:
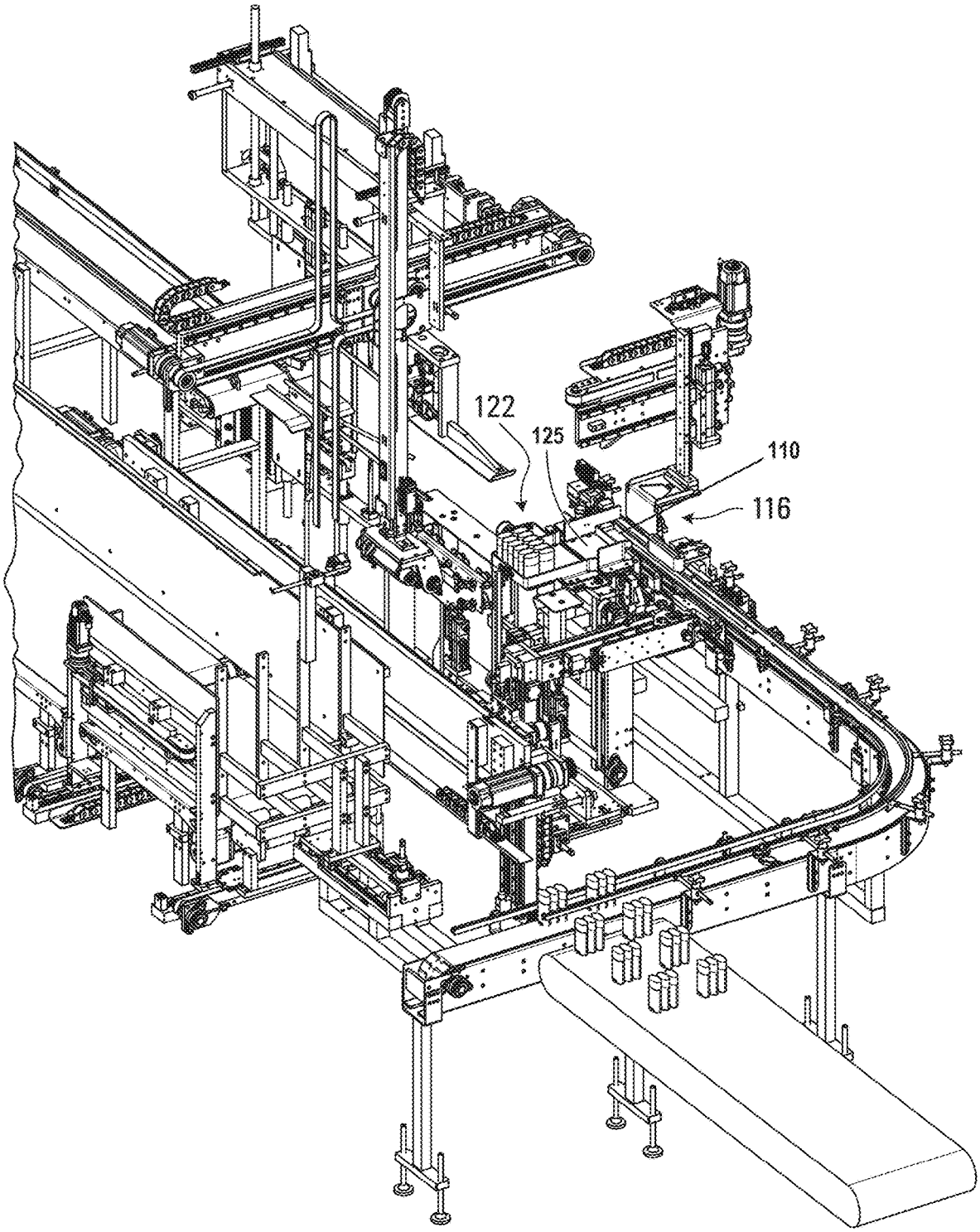
FIG. 5 illustrates, in a back-left-upper perspective view, the system of FIG. 1, in a phase of operation subsequent to the phase illustrated in FIG. 4.
Figure 6:
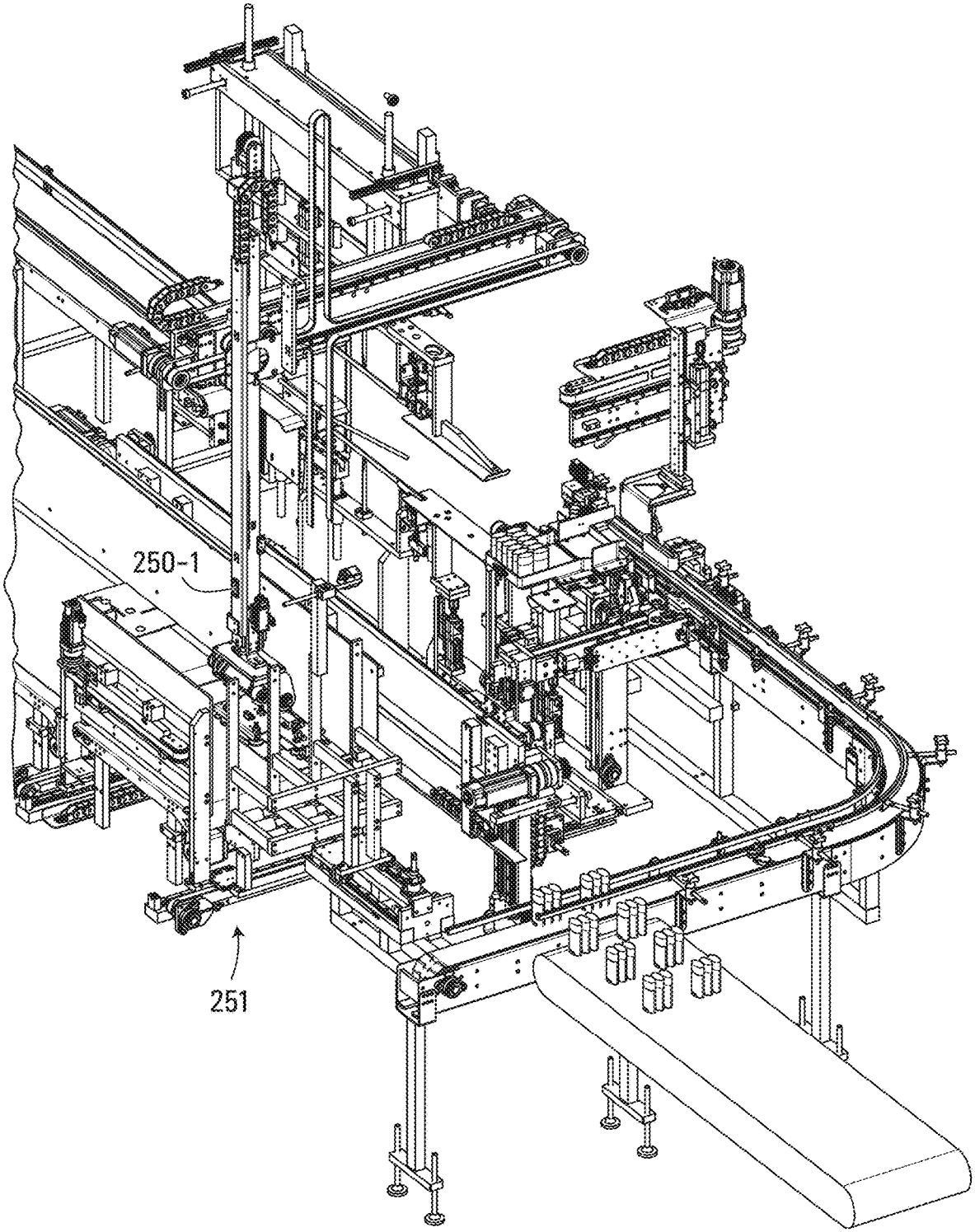
FIG. 6 illustrates, in a back-left-upper perspective view, the system of FIG. 1, in a phase of operation subsequent to the phase illustrated in FIG. 5.
Figure 7:
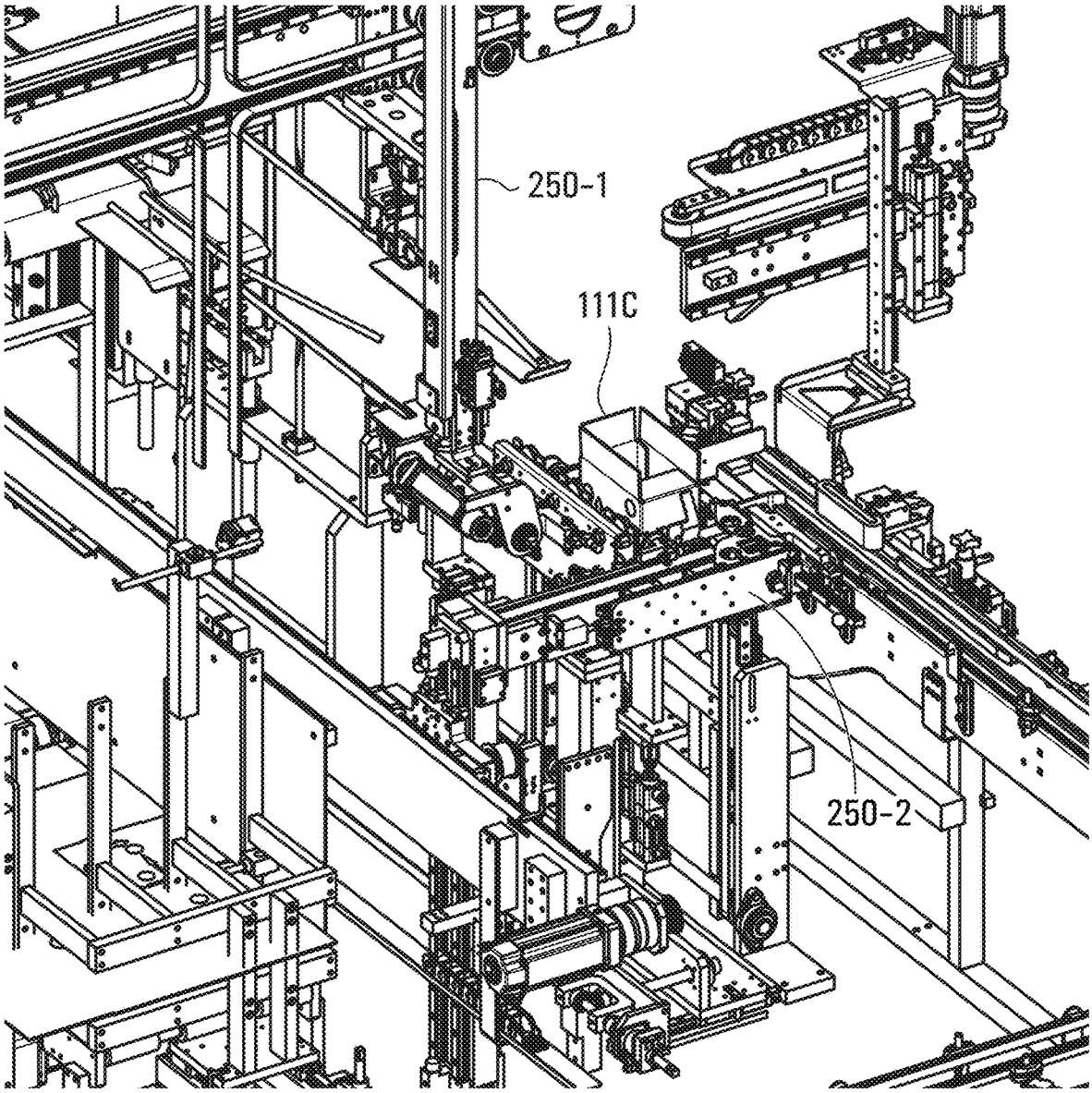
FIG. 7 illustrates, in a back-left-upper perspective view, the system of FIG. 1, in a phase of operation subsequent to the phase illustrated in FIG. 6.

In operation, a header 116 may be operable to successively transfer a plurality of items from the infeed conveyor 104 to a collation platform 125 (see FIG. 5) to, thereby, form a collated group 122 of items. The system 100 may also include an area where the collated group 122 of the plurality of items 102 may be loaded into the erected case blank 111C (see FIG. 3C), thereby producing a loaded case. Subsequently, the system 100 may act on the loaded case to close the end flaps and seal the loaded case. The process of forming the collated group 122, loading the collated group 122 into its own respective erected case blank 111C and sealing the case may be repeated.

In some aspects of the present application, top end flaps of each erected case blank 111C may be closed and sealed, or partially sealed, prior to loading of the groups 122 of items 102 therein. Within the casing area there may be located several components, including the first cartesian robot 250-1, the second cartesian robot 250-2, a pedestal 140 and a fence 124. The transfer apparatus may operate to successively move the groups 122 of collated items 102 from the collation platform 125 to the pedestal 140.

The collation platform may receive the individual items 102, from the infeed conveyor 104, delivered singly and in series. The items 102 may be delivered to a transfer location as a single line of items, with no spacing between adjacent items 102 in the single line. In other aspects of the present application, the items 102 may be delivered with a predefined spacing therebetween. In further aspects of the present application, the items 102 may be delivered with randomly sized spacing between each of the items 102. The system 100 may be operable to transform the plurality of individual items 102 provided to system 100 into a series of collated groups 122 of items 102, so that each collated groups 122 may be delivered serially to the casing area for loading and sealing in its own case.

The individual items 102 may be delivered by the input conveyor 104, in a series and in a generally vertically upright orientation with each item 102 supported on its base portion, to a transfer station. The transfer station is a location at the end area of the infeed conveyor 104 and at the input area of the collation platform. The plurality of items 102 that form a sub-group of items may be transferred from the input conveyor 104 to the collation platform. Successive sub-groups/rows of the items 102 may be transferred from the input conveyor 104 to the collation platform to form the completed, collated group 122. Several sub-groups/rows of items (each of which may form a single row in the group 122 comprising multiple rows of items) may be aggregated/collated to form the group 122 of the items 102. Thus, between the input conveyor 104 and the collation platform, the individual items 102 may be transformed from a series of individual items 102 delivered in series, into the collated group 122 on the collation platform.

The collation platform may have an item support surface made of a strong, low friction material such as Ultra-High Molecular Weight (UHMW) polyethylene to, thereby, allow the items 102 to easily slide over the item support surface.

The group 122 may be formed on the collation platform in an ordered array of the items 102. For one example, the ordered array may be a rectangular array of a first number, N1, of rows of the items 102 and a second number, N2, of the items 102 in each row. Depending upon the desired configuration of the array of the items 102 when loaded into the erected case blank 111C, adjacent rows of items may be transversely offset from each other. That is, if the items 102 are generally cylindrical, the items 102 may be interleafed at their outer abutting surface areas. The number of the items 102 in each group 122 to be loaded into a single erected case blank 111C may be determined based on one or more specific dimensions and shapes associated with the individual items 102, the shape of the interior storage space 107 in the erected case blank 111C and dimensions of the interior storage space 107.

At least some, if not all, of the components of the system 100 of FIG. 1 may be mounted to a system frame 115. Notably, only some of the system frame 115 is illustrated in the Figures. The system frame 115 may include various inter-connected vertical and horizontal post/beam support members, such as frame members 115'. The system frame 115 may be configured to permit certain components, that are described herein, of the system 100 to be mounted thereto.

In further operation, the collated groups 122 of the items 102 may be sequentially transferred from the collation platform to the pedestal 140 in the casing area, using a combination of the transfer apparatus and the fence 124. At the casing area, each collated group 122 of items 102 may be sequentially bottom loaded into the interior storage space 107 (FIG. 3C) of the erected case blank 111C by having the erected case blank 111C moved by the second cartesian robot 250-2, under control of the PLC 132, in a particular and predetermined path such that the collated group 122 of items 102 is sheathed by the erected case blank 111C. The erected case blank 111C may be moved on a path whereby the erected case blank 111C is tilted at an angle and then brought down over top of the collated group 122 of items 102, so as to encapsulate or enclose the collated group 122 of items 102 within the interior storage space 107 of the erected case blank 111C, while the collated group 122 of items 102 is positioned on the collation platform and while the collated group 122 remains stationary relative to the system frame 115. The path of movement of the erected case blank 111C, as the erected case blank 111C is moved by the second cartesian robot 250-2, may be configured such that none of the lower flaps (e.g., flaps J, K, F, G) are caught on any upper edges or upper surfaces of any of the items 102 in the collated group 122 and such that the erected case blank 111C is moved to a position wherein the lower flaps (e.g., flaps J, K, F and G) remain oriented vertically downwards when the collated group 122 of items 102 has been received within the interior storage space 107 of the erected case blank 111C.

Figure 10:
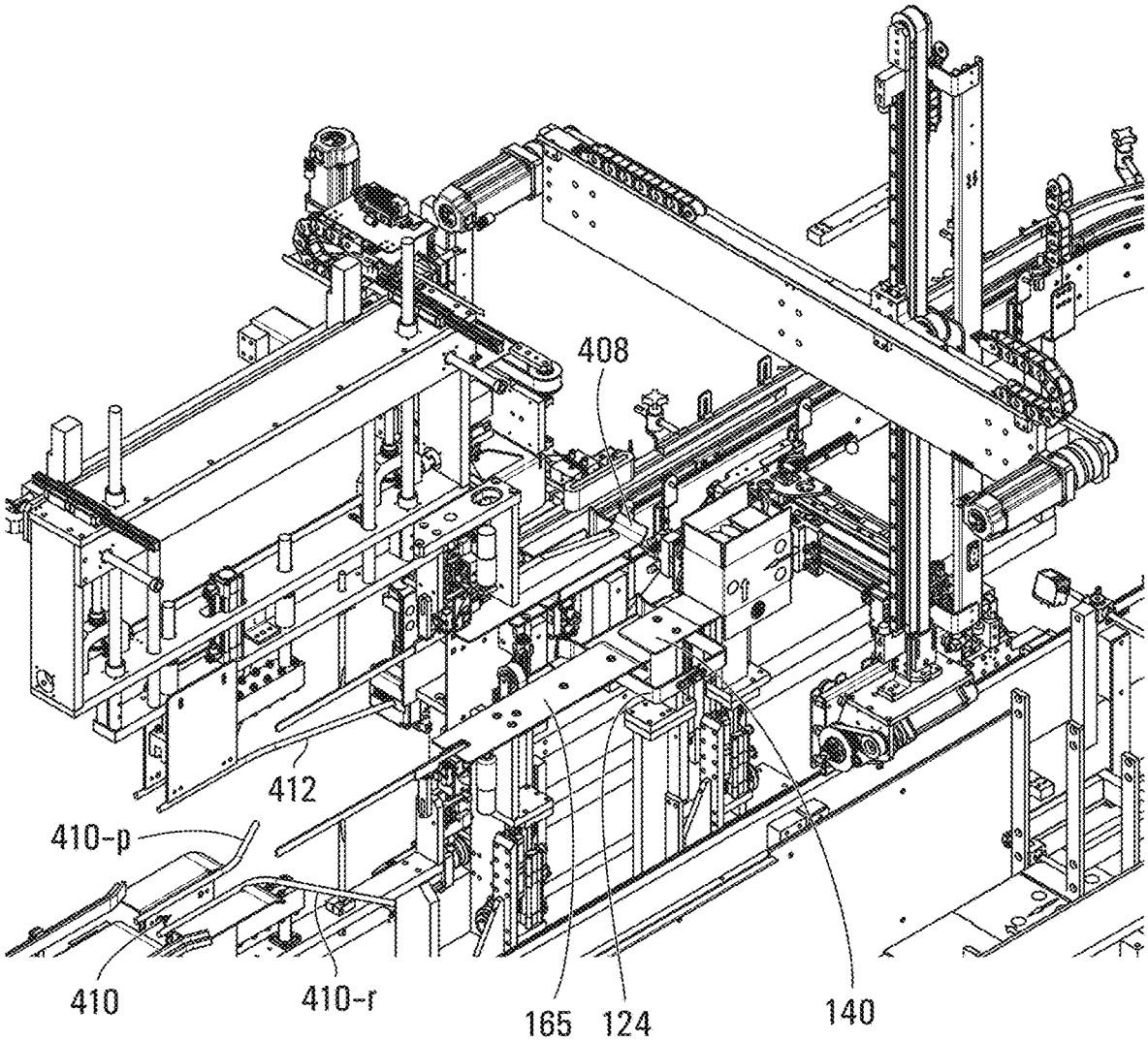
FIG. 10 illustrates, in a back-right-upper perspective view, the system of FIG. 1, in a phase of operation subsequent to the phase illustrated in FIG. 9.

Once the collated group 122 of items 102 has been properly positioned within the interior storage space 107 of the erected case blank 111C, at least two opposed bottom flaps (e.g., the trailing flap G and the leading flap F) of each erected case blank 111C may be moved to a closed position using a combination of the second cartesian robot 250-2, the pedestal 140, a first folding platform 163 (see FIG. 11) and a second folding platform 165 (see FIG. 10). Thereafter, the loaded case blank 111D, with at least the flaps G and F having been moved to a closed position, may be moved, by the second cartesian robot 250-2, from the pedestal 140 to the output conveyor 170. During movement to the output conveyor 170, and/or while being moved on the output conveyor 170, the loaded case blank 111D may have the remaining top and bottom flaps closed and the top and bottom ends may also be fully sealed. Optionally, the loaded case blank 111D may be labelled, using a labelling apparatus, while the loaded case blank 111D is moving through the output conveyor 107. Thereafter, the output conveyor 170 may deliver each loaded and fully sealed case blank 111E to an output station, where, for example, each loaded and fully sealed case blank 111E may be successively stacked on a pallet by a conventional stacking apparatus (not shown) to be ready for shipping to a destination.

Figure 2:
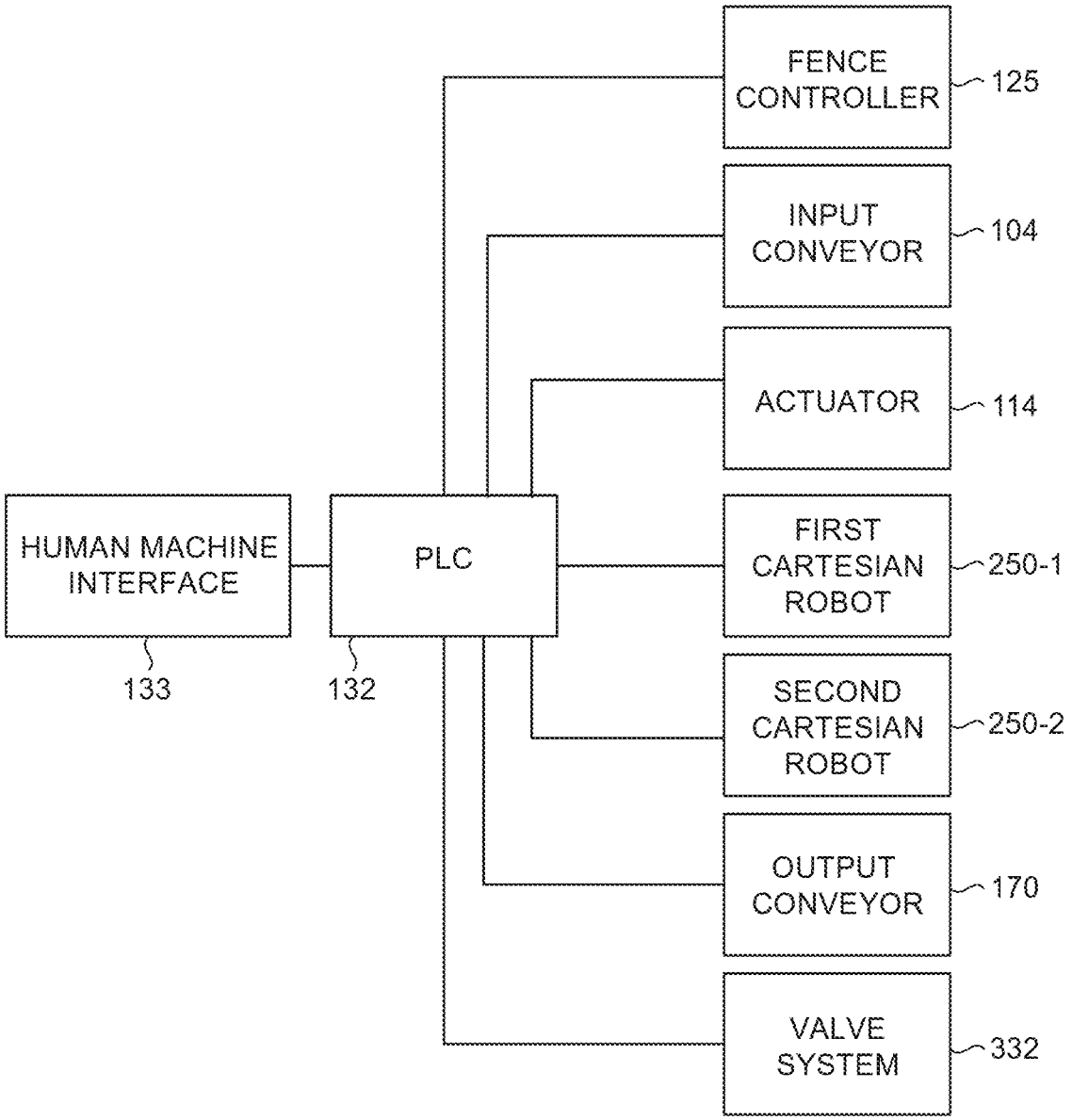
FIG. 2 illustrates, in a block diagram, computer components used to manage the system of FIG. 1, in accordance with aspects of the present application.

An example of a scheme for the power and data/communication configuration for the system 100 of FIG. 1 is illustrated in FIG. 2. The operation of the components of the system 100 may be controlled by the PLC 132. The PLC 132 may be accessed and configured by a human operator through a Human Machine Interface (HMI) module 133 secured to the frame 115. The HMI module 133 may be in electronic communication with the PLC 132. The PLC 132 may be any suitable PLC and may, for example, include a unit chosen from the Logix 5000 series devices made by Allen-Bradley/Rockwell Automation of Milwaukee, Wisconsin, such as the ControlLogix 5561 device. The HMI module 133 may be a Panelview (part number 2711P-T15C4D1) module, also made by Allen-Bradley/Rockwell Automation.

Electrical power may be supplied to the PLC 132/HMI 133 and may be supplied to various servo motors and direct current (DC) motors that are described further herein. Compressed/pressurized air may also be supplied to vacuum generators and pneumatic actuators through valve devices, such as solenoid valves, that are controlled by the PLC 132. Servo motors may be connected to, and may be in communication with, servo drives that are in communication with, and controlled by, the PLC 132. Similarly, DC motors may be connected to DC motor drives that are in communication with, and controlled by, the PLC 132, again all as described further herein. Additionally, various other sensors are in expected to be in communication with the PLC 132 and may (although not shown) also be supplied with electrical power.

With reference to FIGS. 3A, 3B and 3C, an example of one kind of knock-down case blank 111A that can be processed by system 100 to form a regular slotted case (RSC) is illustrated. The system 100 of FIG. 1 may be configured so that other types of knock-down case blanks and knock-down case blanks of different sizes may also be processed.

Each case blank may be generally initially formed and provided in a knock-down configuration 111A—i.e., a flattened tubular configuration—as shown in FIGS. 3A and 3B. Each tubular case blank 111A may have a height dimension "Ht"; a length dimension "L"; and a major panel length dimension "Q" (see FIG. 3A). By inputting, into the PLC 132, each of these three dimensions for a case blank to be processed by the system 100, the PLC 132 may determine whether the system 100 can process a case blank 111A of that size without a necessity for manual intervention to make an adjustment to one or more components of the system 100. If the PLC 132 determines that an adjustment can be made without human intervention, the PLC 132 may make the necessary adjustments to positions and/or movements of at least some of the components forming the system 100.

As will be described further hereinafter, the tubular case blank 111A may be transformed from a knock-down configuration (i.e., a generally flattened tubular configuration) to an open-sleeve, erected configuration (open tubular configuration, "the erected case") associated with reference numeral 111C. The erected case blank 111C may be loaded and the end flaps may be folded and sealed to form a desired erected, loaded and fully closed and sealed case configuration 111E (more succinctly called "the loaded and fully sealed case blank 111E"). The system 100 may be configured to deliver each erected case blank 111C with a downwardly facing, bottom opening with flaps F, G, J, K being in an orientation that is generally planar with corresponding connected side panels A, C, B and D, suitable for loading a group of items 102 through the bottom opening into the interior storage space 107 of the erected case blank 111C, where the group of items 102 are to be held.

Figure 4:
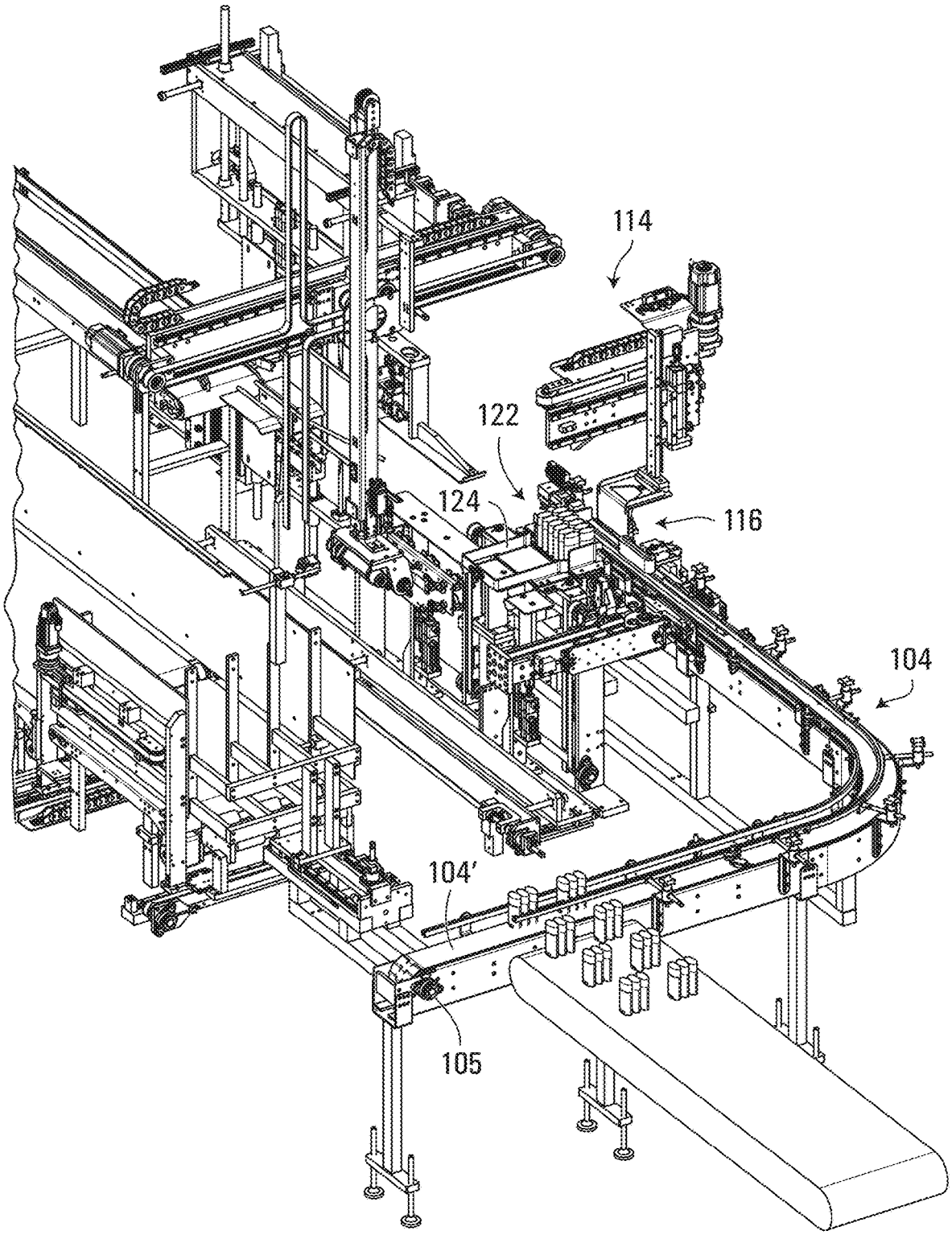
FIG. 4 illustrates, in a back-left-upper perspective view, the system of FIG. 1, in a phase of operation.

With reference now to FIG. 4, the infeed conveyor 104 may be a driven conveyor with a moving conveyor belt 104' that provides an upward facing, moving support surface that can support the plurality of items 102 thereon. The infeed conveyor 104 may be configured to deliver the individual items 102 from a source/supply of such items to a transfer location at the transfer station 110, adjacent to, and generally level with, the support surface of the collation platform. The support surface of the conveyor belt 104' of the infeed conveyor 104 may be configured as a movable continuous belt having an upper run and lower run with items supported on the upper run. The support surface of the conveyor belt 104' of the infeed conveyor 104 may made from a suitable material that will allow items to easily slide over the support surface of the conveyor belt 104' when pushed by the header 116. Example suitable materials include hard plastic materials that are commonly used in belt conveyors. The conveyor belt 104' may be driven by a conveyor belt motor 105, such as a DC motor or a variable frequency drive motor controlled by the PLC 132 through a DC motor drive. One example suitable DC motor drive is model AXH-5100-KC-30 from the Oriental Motor Co., Ltd. Of Japan. The upward facing surface of the conveyor belt 104' may have an end-run portion at a location that is adjacent to a forward transverse edge region of the support surface of the collation platform. In other aspects of the present application, other types of item delivery/supply apparatuses may be provided, including other types of conveyors, such as, by way of example only, magnetic conveyors or roller conveyors.

The system 100 of FIG. 1 may also include the transfer apparatus at the transfer station oriented in a direction transverse to the direction of motion of the items 102 on the infeed conveyor 104. The transfer apparatus may have a pusher header 116 that operates across the end of the conveyor belt 104' of the infeed conveyor 104 and onto the forward edge region of the collation platform. The transfer apparatus may include an actuator 114 attached to pusher header 116 that is capable of intermittent, linear, reciprocating back and forward movement under the control of the PLC 132. When activated by the PLC 132, the actuator 114 may be configured to translate the header 116 between a first, retracted position and a second, extended position, in a direction that may be generally perpendicular to the direction of inflow of the items 102 on the conveyor belt 104' at the end region of the infeed conveyor 104. The reciprocating, linear movement of the header 116 may be generated using a piston, lead screw, or belted motor system. An example suitable motor is a servo motor, such as the model MPL-B330P-MJ24AA made by Allen-Bradley. The header 116 may be removably or permanently affixed to a support beam.

According to some aspects of the present application, the header 116 with a particular shape/set of dimensions may be removed and interchanged with another header 116 having an alternative shape/set of dimensions. It follows that, if the size and/or shape of individual items 102 require a specific design for the header 116, a header of a desired shape/dimensions may be selected and installed to correspond/fit the items 102 being processed by the system 100 at a particular time. The header 116 may have a generally flat pushing surface that is vertically oriented and that also extends across the body regions of the plurality of individual items 102 located at the end region of the infeed conveyor 104. In some aspects of the present application, the header 116 may have a complementary engaging surface shape to that of the body region surface shape of the individual items 102 being delivered by the infeed conveyor 104. For example, the header 116 may have a plurality of concave surface shapes arranged in series, which concave surface shapes closely match the convex outer surfaces shapes of the plurality of items 102 arranged in series, when located at the end region of the infeed conveyor 104.

As shown in FIG. 4, in a first retracted position, the header 116 does not impede a flow of the infeed conveyor 104 and is positioned outside of the conveyor path of the conveyor belt 104' in the end region. This lack of impedance allows an inflow of several of the individual items 102 into the end transfer region of the infeed conveyor 104. Therefore, several of the individual items 102 that form the group 122 of items may be positioned to extend across the width of the operational surface of the header 116.

The system 100 of FIG. 1 may be configured to operate the infeed conveyor 104 (with the items 102 delivered in a tight-contact, serial formation) and the header 116 in a manner that provides for the smooth sliding movement of each sub-group of items 102 from the infeed conveyor 104 onto the collation platform to form a row of items 102. For example, based on a calculated timing of operation of the infeed conveyor 104, the PLC 132 may send an input signal to intermittently start and stop movement of the infeed conveyor 104 to deliver the given number, N2, of items 102 to a transfer position. Alternatively, one or more electronic eye sensors, such as the model 42KL-D1LB-F4 eye sensors made by Allen-Bradley may be communicably linked to the PLC 132. A sensed value/signal may indicate that the number, N2, of specific individual items 102 that will form a row are all located in the desired specific positions at a transfer position. Responsive to receiving the sensed value/signal, the PLC 132 may signal to the infeed conveyor 104 to stop movement of the conveyor belt 104' of the infeed conveyor 104. The number of individual products 102 that are positioned on the infeed conveyor 104, spanning across the operational surface of the header 116 and forming a row of items 102, may correspond to the number, N2, of items that are desired for the collated row for each arrayed group 122 of products 102 that it is desired to fit into the loaded and fully sealed case blank 111E, the loaded and fully sealed case blank 111E containing the number, N1, of the collated rows in the arrayed group.

The header 116 may be configured and operable to move from the first, retracted position to a second, extended position in a plough-like movement, to transversely push and slide the number, N2, of individual items 102 in the sub-group at the transfer location from the infeed conveyor 104 onto an upper item support surface of the collation platform.

Responsive to the PLC 132 determining that the collated row is present at the transfer position spanning across the surface of the header 116, the PLC 132 may send a signal to the actuator 114 to activate and, thereby, initiate movement of, the header 116. In operation, the header 116 carries out movement from the first position to the second position. Through this movement, the header 116 will push against the individual items 102 to, thereby, push the individual items 102 from the infeed conveyor 104 onto the collation platform. This movement may be accomplished in a manner that causes the individual items 102 to slide smoothly and together on their bases from the infeed conveyor 104 onto the upper surface of the collation platform. The movement of the header 116 may be carried out at a predefined speed. Accordingly, the movement of the collated row of the items 102 may be of a character that the individual items 102 will be less likely to topple over than the individual items 102 would be if the movement was carried out at a speed higher than the predefined speed. This movement is expected to result in a first collated row on the collation platform.

After moving from the first position to the second position, the header 116 will be returned back to the first position (i.e., the position occupied by the header 116 as illustrated in FIG. 4) under control of the PLC 132. Once the header 116 has been returned to the first, retracted position, a new subgroup of individual items 102 may be delivered to the end region of the infeed conveyor 104 and the transfer location, under control of the PLC 132. This subgroup may then also be pushed by the header 116 onto the collation platform, also causing any prior sub-groups/rows of items 102 that are already on the collation platform, to move longitudinally, further downstream on the support surface of the collation platform. This process may be repeated until the desired number, N1, of subgroups of items 102, arranged in collated rows, are on the collation platform to form a desired size of the group 122 of collated items 102 to be loaded into the erected case blank 111C.

The item support surface of the collation platform may be a low friction material to, thereby, allow for easy sliding of the items 102 supported on their bases, across the adjacent and vertically and transversely aligned upward facing support surfaces. Side plates may be also provided in association with the collation platform. The side plates may extend on both transverse sides of the length of the collation platform to, thereby, form bumper members (bumpers) with inward facing support surfaces at a fixed width/transverse spacing corresponding to the width of the collated row. The bumpers may be constructed with metal support frames and may have inner support surfaces of a similar low friction, high rigidity material such as UHMW polyethylene, to allow each of the collated rows to maintain its positioning and to restrict sliding movement to a single dimension (e.g., easy sliding along the collation platform).

According to some aspects of the present application, the distance between the bumpers may be adjustable, such that the bumpers may be repositioned to operate with the header 116 when the header 116 has different width dimensions, to allow for different dimensions of the collated items 102 and/or different numbers of items in each of the collated rows of the desired group 122. For automatic adjustment by the PLC 132, the bumpers could be mounted on an adjustment mechanism that provides for spacing adjustments through operation of a servo motor, in a manner similar to the manner described elsewhere herein.

Responsive to determining that the desired group 122 has been collated upon the collation platform, the header 116 may be activated to transfer the group 122 of collated items 102 from the collation platform to the pedestal 140. The fence 124 surrounds the group 122 of collated items 102 on three sides, thereby providing support and acting to prevent tipping of the items 102.

Once transferred to the pedestal apparatus 140, each group 122 of items 102 may then be sheathed/covered with the erected case blank 111C under control of the second cartesian robot 250-2.

The pedestal 140 may be located among generally horizontal support surfaces upon which the collated group 122 of items 102 may be moved over and supported while being sheathed by/enclosed within the erected case blank 111C under control of the second cartesian robot 250-2. The horizontal support surfaces associated with the pedestal 140 may be made from a suitably strong, low friction material, such as a low friction stainless steel. Transfer from the collation platform to the pedestal 140 may be performed using the header 116 to move each collated group 122 of items 102 from the collation platform.

The pedestal 140 may facilitate/assist with the sheathing of the groups 122 of items 102 with the erected case blanks 111C, as well as the closing of the leading and trailing bottom flaps F, G respectively of the erected case blanks 111C, as described further hereinafter. Accordingly, the leading and trailing flaps F, G of the erected case blanks 111C are moved into closed, support positions beneath the group 122 of items 102 that are positioned within the interior storage space 107 of each erected case blank 111C. The pedestal 140 may be associated with the first folding platform 163 and the second folding platform 165. Each of the first folding platform 163, the pedestal 140 and the second folding platform 165 may have upwardly directed support surfaces for supporting the items 102 thereon. The positions of the support surfaces of the first folding platform 163, the pedestal 140 and the second folding platform 165 may be capable of limited vertical and longitudinal adjustment relative to each other.

Movement of successive groups 122 of items 102 across the pedestal apparatus 140 may be achieved using the second cartesian robot 250-2.

As the group 122 of collated items 102 is being delivered, by the header 116, from the collation platform to the pedestal 140, a knocked-down, flattened case blank 111A may have already been retrieved, by the first cartesian robot 250-1, from, or within, the blank magazine 251. Through cooperation between the first cartesian robot 250-1 and the second cartesian robot 250-2, the flattened case blank 111A may be converted to an erected case blank 111C.

According to some aspects of the present application, the blank magazine 251, containing a stack of knock-down case blanks 111A, may be situated within an operating radius/reach of the first cartesian robot 250-1. A first end effector 252-1 may be mounted to the first cartesian robot 250-1. Similarly, a second end effector 252-2 may be mounted to the second cartesian robot 250-2.

The first end effector 252-1 may be provided with a first set of suction cups 313-1. Similarly, the second end effector 252-2 may be provided with a second set of suction cups 313-2. Vacuum forces may be generated at the suction cups 313-1, 313-2 in a variety of ways, including providing hoses delivering pressurized air to vacuum generators mounted on the end effector 252, with the vacuum generators interconnected to the suction cups 313-1. Electronic valves (not shown) that are part of the valve system 332 (FIG. 2) under control of the PLC 132 may be provided to control the flow of pressurized air to the vacuum generators and, thus, to control the vacuum at suction cups 313-1, 313-2. The electronic valves may be understood to allow for turning on and turning off of the vacuum generated at the suction cups 313-1, 313-2. It should be noted that, while many types of suction cups 313-1, 313-2 may be employed on the first end effector 252-1, a preferred type of suction cup is the model B40.10.04AB made by Piab AB of Danderyd, Sweden. Each suction cup 313-1, 313-2 may be connected to an outlet from a vacuum generator. The vacuum generator may be any suitable vacuum generator device, such as, for example, the model VCH12-016C made by Pisco of Elk Grove Village, IL. Vacuum generators are known to have an inlet interconnected to a hose (not shown) that can carry pressurized air from an air compressor or other vacuum source to the vacuum generator. The vacuum generator converts the pressurized air supplied to the inlet port into a vacuum at one of the vacuum outlet ports. That vacuum outlet port is interconnected to one of the suction cups 313-1, 313-2 so that the suction cup can have a vacuum force. A solenoid valve device that is part of the valve system 332 may be interposed along the pressurized air channel running between each vacuum generator and the source of pressurized air. The solenoid valve device may, for example, be a model CPE14-M1BH-5L-1/8 made by Festo of Esslingen am Neckar, Germany. The valve system 332 is in electronic communication with the PLC 132 and controlled by the PLC 132. In this way, the PLC 132 can turn on and turn off the supply of vacuum force to the suction cups 313-1, 313-2.

The first cartesian robot 250-1, with the first end effector 252-1, under control of the PLC 132, may be operable for successively picking up the knock-down flat case blank 111A located at the case blank pick up position in the blank magazine 251, rotating the flat case blank 111A through 90 degrees, or so, and moving the flat case blank 111A over to the second cartesian robot 250-2. The second cartesian robot 250-2 may be shown to assist in the opening of the flat case blank 111A to form the erected case blank 111C. The first cartesian robot 250-1 may then release the erected case blank 111C, thereby allowing the second cartesian robot 250-2 to move the erected case blank 111C towards the pedestal 140.

When the group 122 of collated items 102 is located at the pedestal 140, the second cartesian robot 250-2 may manipulate the path of the second end effector 252-2 and the erected case blank 111C held by the second end effector 252-2, to sheath the group 122 of items 102 resting on the pedestal 140.

According to some aspects of the present application, the blank magazine 251, holding the knock-down flat case blanks 111A, may be configured to lift the stack of flat case blanks 111A to an operating height, such that the topmost flat case blank 111A is always in a specific position. According to other embodiments, the first end effector 252-1 may be equipped with an electronic eye sensor (not shown), such as the model 42KL-D1LB-F4 made by Allen-Bradley. The electronic eye sensor may be configured to detect the position of the top-most knock-down case blank 111A and generate signals for the PLC 132 to follow a specific path for movement of the first cartesian robot 250-1.

The first end effector 252-1 may engage with the knock-down case blank 111A. The first cartesian robot 250-1 may raise the first end effector 252-1, thereby lifting the knock-down case blank 111A vertically, that is, in the Z-direction. In consequence of vertically raising the knock-down case blank 111A, the knock-down case blank 111A may begin to open up.

The first cartesian robot 250-1 may continue to move the knock-down case blank 111A vertically upwardly while, concurrently moving the knock-down case blank 111A horizontally, toward the pedestal 140, on which the group 122 of collated items 102 is located. Upon arrival at a location vertically above the pedestal 140, the second cartesian robot 250-2 may be moved, under control of the PLC 132, such that the second set of suction cups 313-2, of the second end effector 252-2, may engage the knock-down case blank 111A to, thereby, complete the opening of the knock-down blank 111A to become the erected case blank 111C with a substantially right-angle cross section. The first set of suction cups 313-1 may then release their hold on the erected case blank 111C, thereby allowing the first cartesian robot 250-1 to return to the blank magazine 251 to pick up another knock-down flat case blank 111A.

Figure 8:
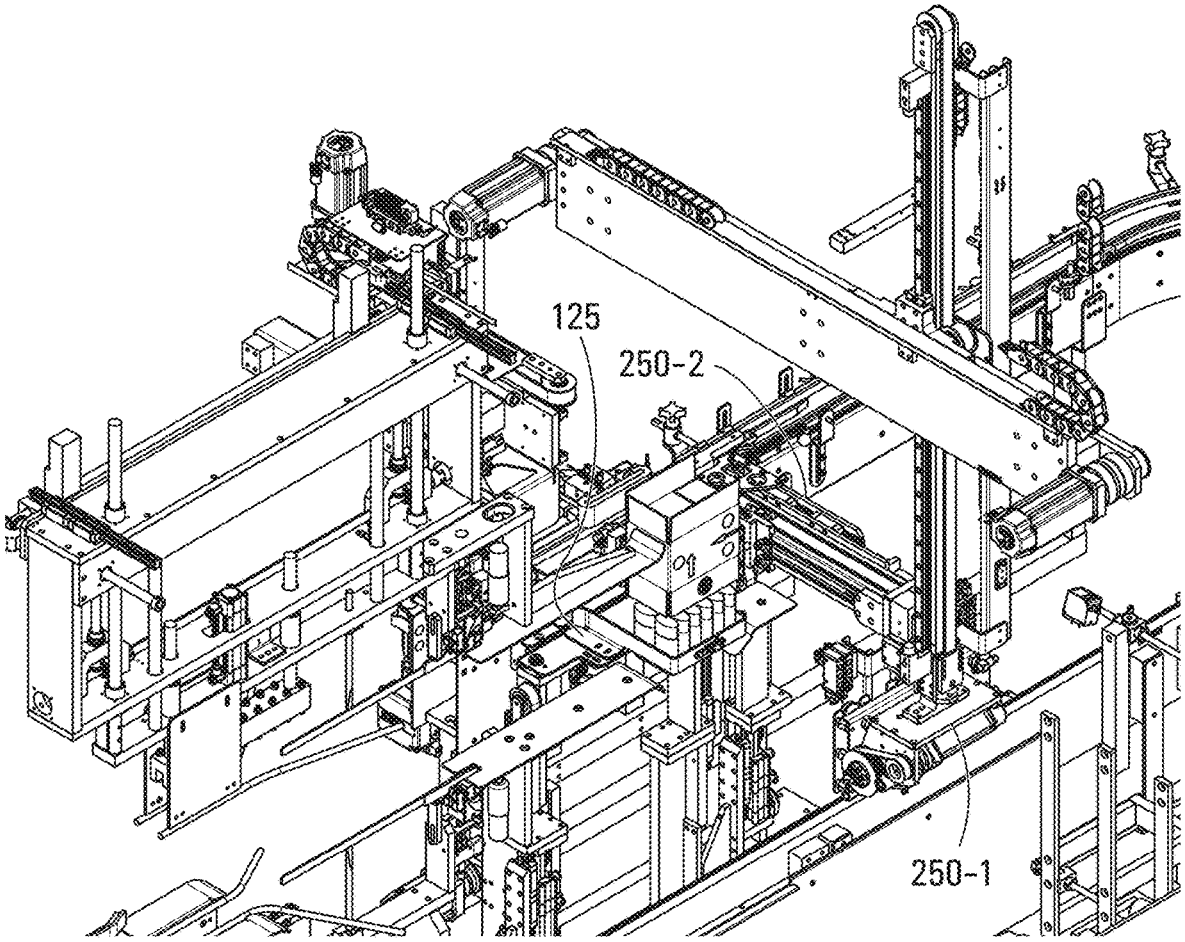
FIG. 8 illustrates, in a back-right-upper perspective view, the system of FIG. 1, in a phase of operation similar to the phase illustrated in FIG. 7.
Figure 9:
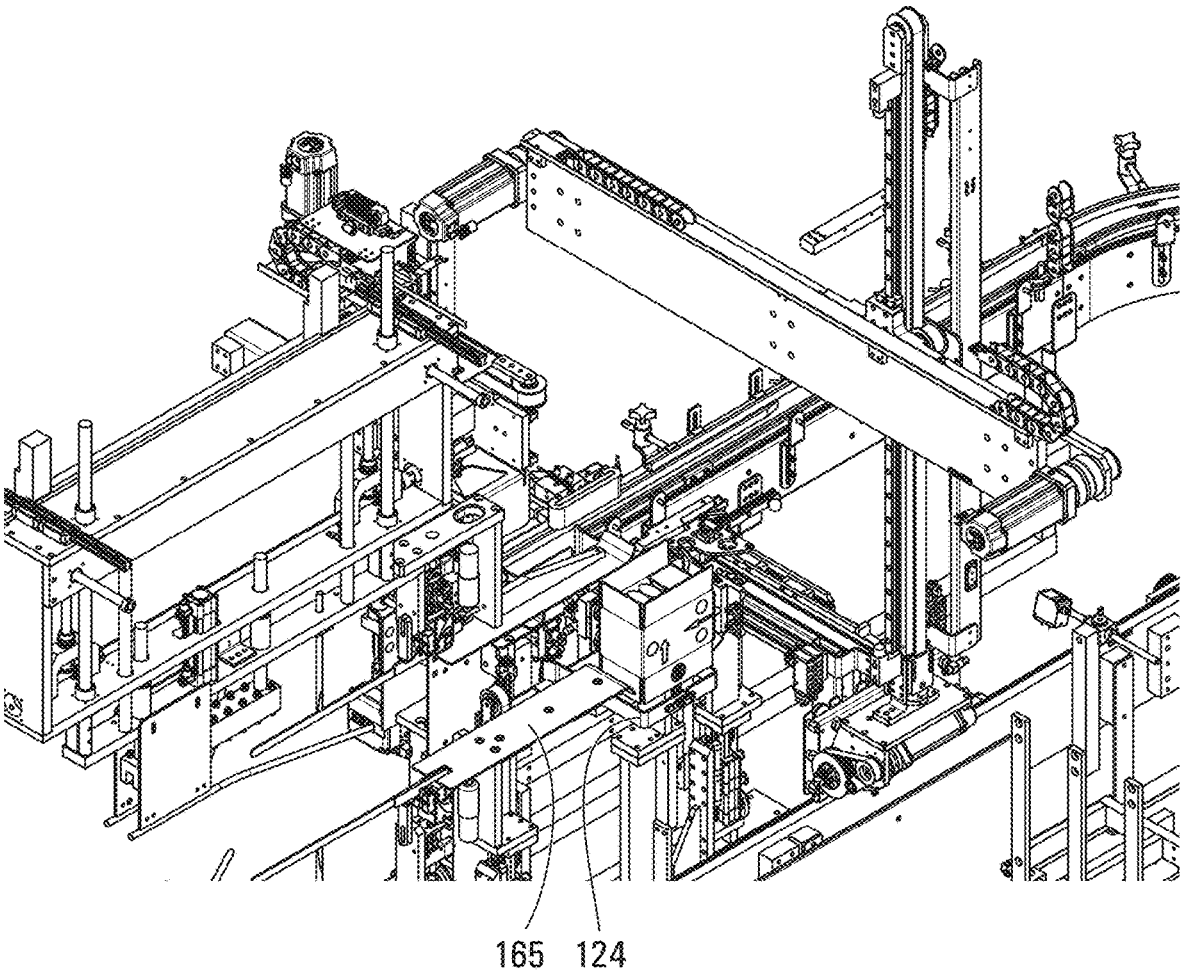
FIG. 9 illustrates, in a back-right-upper perspective view, the system of FIG. 1, in a phase of operation subsequent to the phase illustrated in FIG. 8.

The erected case blank 111C (having a configuration illustrated in FIG. 3C) may be moved, by the second end effector 252-2, to a preloading position (see FIG. 8) above the pedestal 140, then to a fully engaged position (see FIG. 9) and then to a fully loaded position (see FIG. 11) with the group 122 of items fully located within the bounds of the interior storage space 107 of the erected case blank 111C. In this fully loaded position, the erected case blank 111C has been placed over the collated group 122 of items 102 while the group 122 is positioned on the pedestal 140.

According to aspects of the present application, the erected case blank 111C can be placed in the pre-loading position and orientation (see FIG. 8) generally above the pedestal 140 and at a vertical distance sufficiently above the uppermost surface of the items 102 in the group 122 to be loaded. Notably, in the initial pre-loading position (see FIG. 8), no portion of the bottom edges of any of the bottom flaps J, K, F, G may be vertically below the top surface of the items 102. This initial pre-loading position (see FIG. 8) allows the group 122 of items to be moved onto the pedestal 140 with sufficient clearance to avoid contact with any items and/or cause any bottom flaps to become misaligned with their respective side panels.

As the second cartesian robot 250-2 moves the second end effector 252-2 and, consequently, the erected case blank 111C, vertically downwards, toward the fully loaded position (see FIG. 11), the fence 124 may be also be moved by fence support apparatus 123*a*, 123*b* (see FIGS. 12A, 12B and 12C), under control of the PLC 132, vertically downwards away from the group 122 of items.

The second cartesian robot 250-2 may continue to move the second end effector 252-2, and the erected case blank 111C held by the second end effector 252-2, to fully sheath the group 122 of items 102 with the erected case blank 111C. In this fully loaded position (see FIG. 11), the group 122 of items 102 is located entirely within the interior storage space 107 of the erected case blank 111C and the side bottom flaps J and K (along with bottom leading flap F and the trailing bottom flap G) are all positioned below the item support surface of the pedestal 140.

Figure 11:
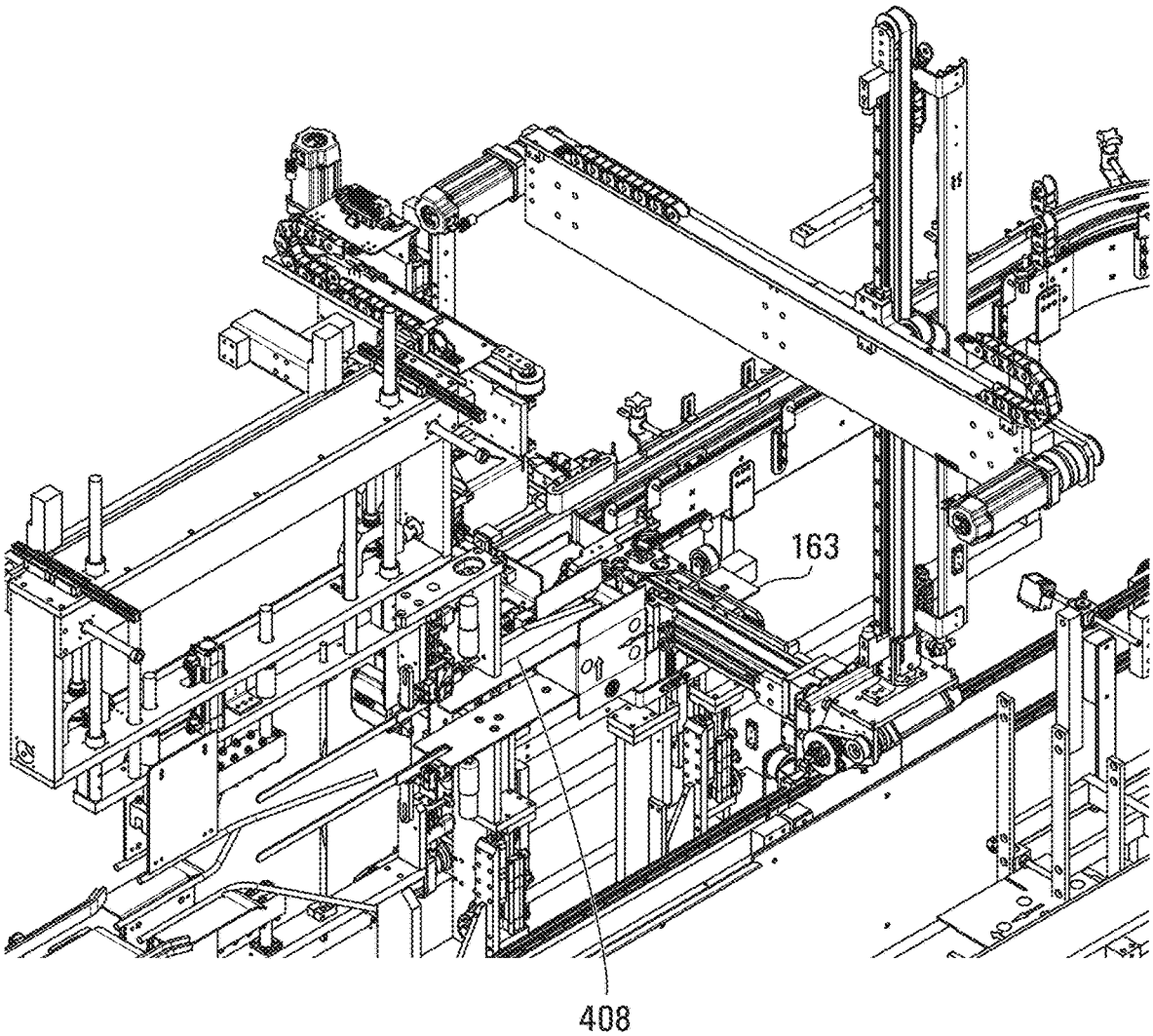
FIG. 11 illustrates, in a back-right-upper perspective view, the system of FIG. 1, in a phase of operation subsequent to the phase illustrated in FIG. 10.
Figure 12A:
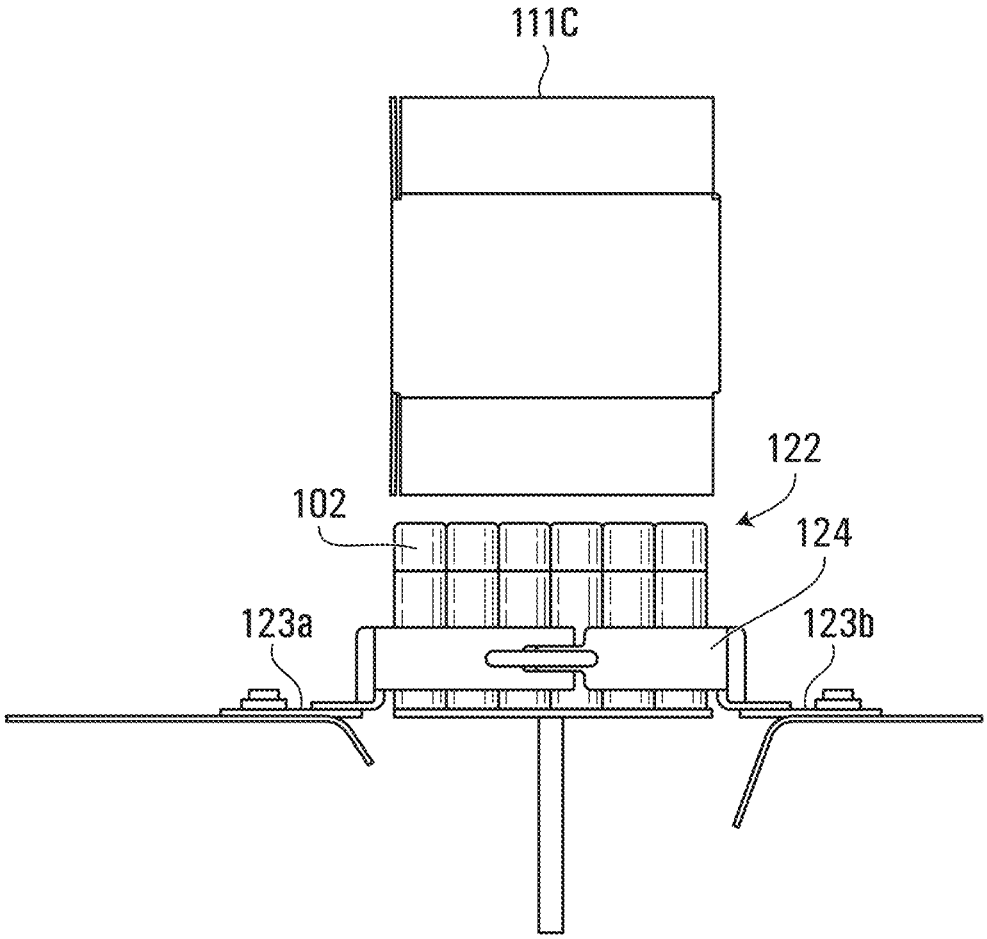
FIG. 12A illustrates, in a front-plan view, a subset of components of the system of FIG. 1, including an erected case blank, a fence and a pedestal supporting a plurality of items, wherein the erected case blank is held above the plurality of items.
Figure 12B:
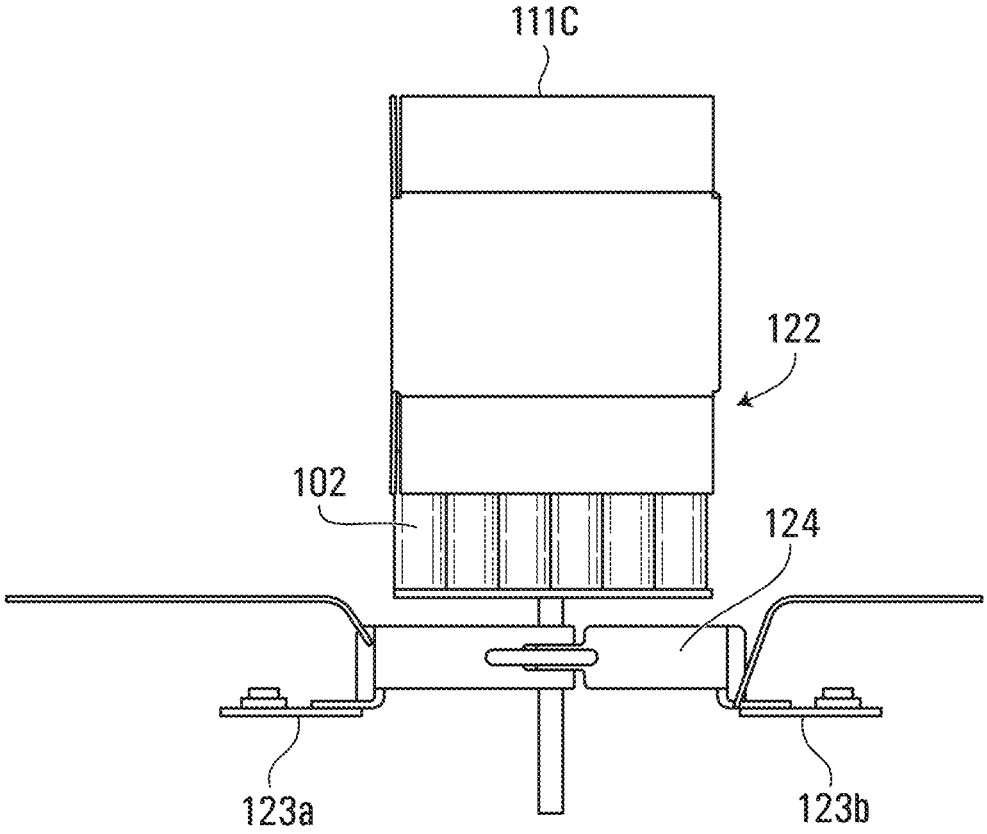
FIG. 12B illustrates, in a front-plan view, the subset of components illustrated in FIG. 12A, wherein the erected case blank is has been moved to partially sheath the plurality of items.
Figure 12C:
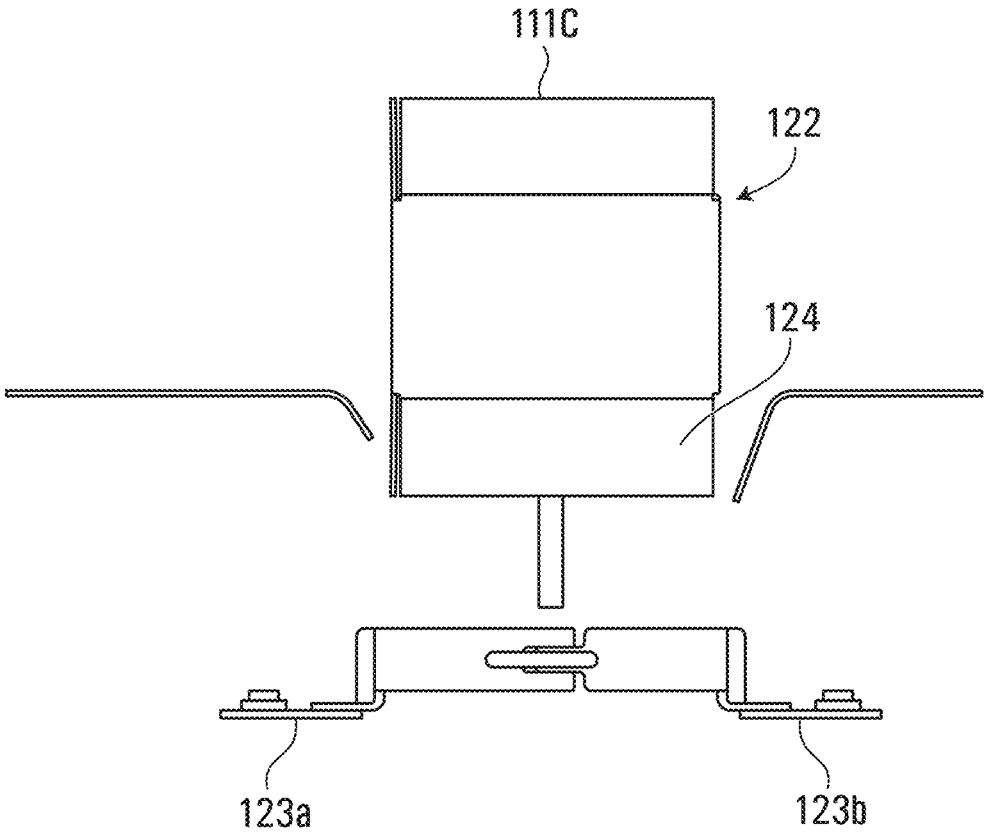
FIG. 12C illustrates, in a front-plan view, the subset of components illustrated in FIG. 12A, wherein the erected case blank is has been moved to fully sheath the plurality of items.

Turning to FIGS. 10 and 11, the leading bottom flap F and the trailing bottom flap G of the erected case blank 111C may be folded about their joints with panel A and panel C, respectively, via horizontal, longitudinal movements across the pedestal 140.

The first folding platform 163, the second folding platform 165 and the pedestal 140 are illustrated as supported by a pedestal support frame.

Figure 13:
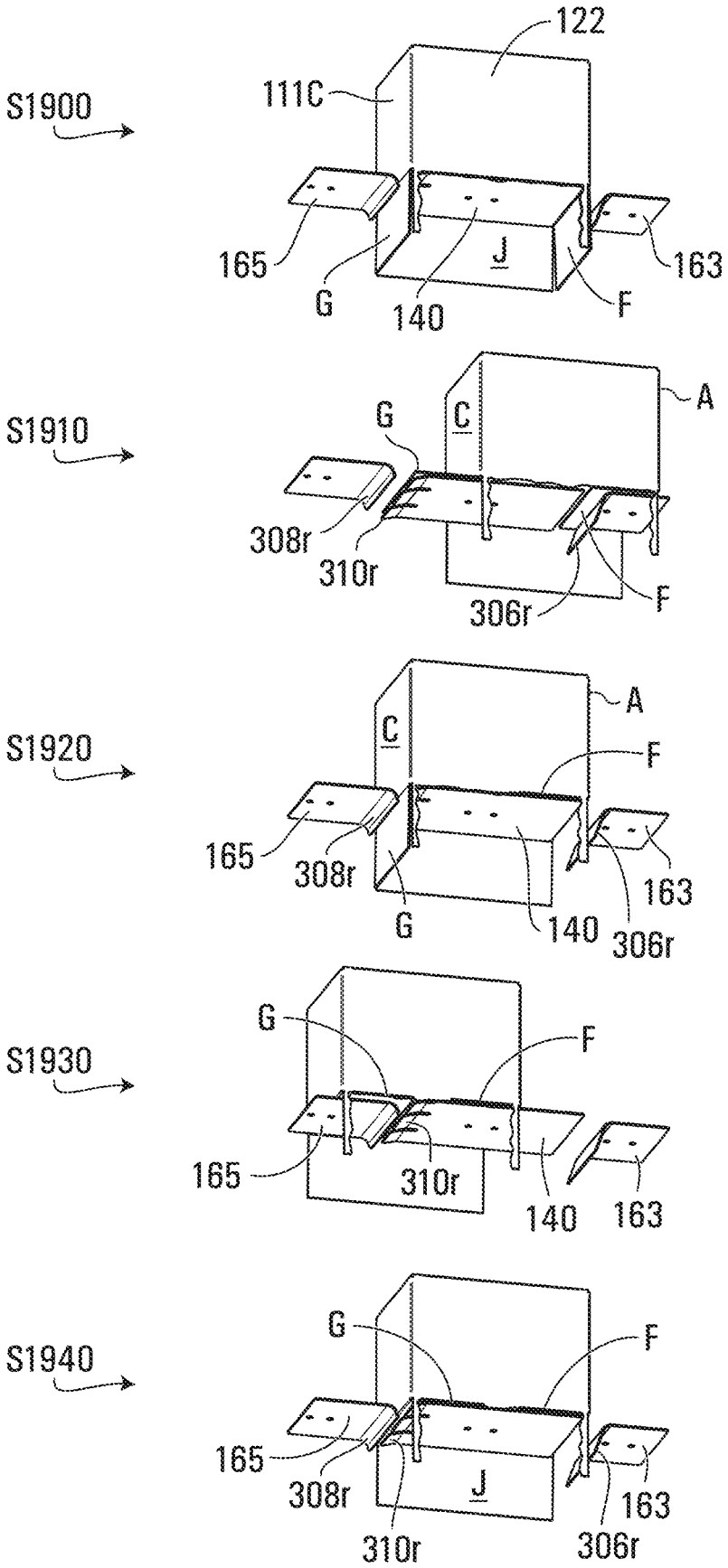
FIG. 13 illustrates, in a schematic perspective view, a subset of components of the system of FIG. 1, including an erected case blank, a pedestal, first folding platform and a second folding platform, the subset being shown in various positions of a loaded case blank during movement across the pedestal, the first folding platform and the second folding platform, in accordance with aspects of the present application.

By moving the erected case blank 111C right/longitudinally rearward (away from the output conveyor 170) using the second cartesian robot 250-2 moving the second end effector 252-2, the leading bottom flap F may be shown to be folded inwardly onto the top surface of the first folding platform 163 beneath the items, this motion being assisted by a first ramp 306*r*. At the same time, the trailing bottom flap G may be shown to be folded outwardly onto the top of the pedestal 140, while the trailing bottom flap G is deflected upwards with the assistance of a second ramp 310*r*. This motion is illustrated between steps S1900 and S1910 in FIG. 13.

Next, the first folding platform 163 and the second folding platform 165 may be raised, under control of the PLC 132, so their top support surfaces are at a position slightly higher than the support surface of the pedestal 140 (with the surface of the second folding platform 165 being raised slightly more than the surface of first folding platform 163). According to some aspects of the present application, the first folding platform 163, the second folding platform 165 and the pedestal 140 may all be similar in size. The second cartesian robot 250-2 moving the second end effector 252-2 may then shift the erected case blank 111C back to the left/forward (i.e., onto the pedestal 140) as illustrated in step S1920.

As may be apparent in S1920, as the loaded case blank 111D shifts onto the pedestal 140, the trailing bottom flap G is folded back vertically downwards to substantially its starting orientation, perpendicular to the item support surfaces of the pedestal 140. This folding action is effected by the leading edge of the trailing bottom flap G, catching a third ramp 308*r* of the second folding platform 165—due to the surface of the second folding platform 165 having been raised to a position above the surface of the pedestal 140—and being directed/deflected downwards. The leading bottom flap F is illustrated as being located between the top surface of the pedestal 140 and the bottom surface of the items.

Next, the first folding platform 163 may be lowered, under control of the PLC 132, to a position where the support surface of the first folding platform 163 is slightly below (e.g., approximately 0.5" below) the support surface of the pedestal 140 and the second cartesian robot 250-2 moving the second end effector 252-2, under control of the PLC 132, may act to shift the loaded case blank 111D forwards towards the second folding platform 163, as illustrated as S1930. During this shift onto the second folding platform 165, the trailing bottom flap G may be shown to be deflected upwards and folded onto the top surface of the second folding platform 165 beneath the items, this motion being assisted by the third ramp 308*r*, such that the loaded case blank 111D and the bottom flaps F, G, reach the position illustrated as S1930. In this position, the trailing bottom flap G is now also folded horizontally inwards and is perpendicular relative to the vertical side walls of the loaded case blank 111D. The trailing bottom flap G is located between the top surface of the first folding platform 163 and the bottom surface of the items.

In a final movement of the sequence, the second folding platform 165 may be moved, under control of the PLC 132, so that the support surface of the second folding platform 165 is in a slightly raised position higher (e.g., approximately 0.5" higher) than the support surface of the pedestal 140 and the second cartesian robot 250-2 moving the second end effector 252-2 may act to shift the loaded case blank 111D rearward to be located completely upon the surface of the pedestal 140, such that, during the shift rearward, the trailing bottom flap G is maintained in a horizontal position and the leading edge of the trailing bottom flap G catches the second ramp 310*r* of the pedestal 140.

Thus, as shown in S1940, when the loaded case blank 111D and the items 102 contained therein are centrally located on the support surface of the pedestal 140, the leading bottom flap F and the trailing bottom flap G have been both folded horizontally inwards and are perpendicular relative to the vertical side walls of the loaded case blank 111D. The leading bottom flap F is located between the top surface of the pedestal 140 and the bottom surface of the items. The trailing bottom flap G is located between the top surface of the pedestal 140 and the bottom surface of the items. The result is that the bottom flaps F and G have both been moved into an operationally closed supporting position beneath the rows of items 102.

Variations of the foregoing sequential movements of the loaded case blank 111D and the bottom flaps F, G, relative to the first folding platform 163, the pedestal 140 and the second folding platform 165 are possible. For example, in a first movement of the loaded case blank 111D effected by the second cartesian robot 250-2 moving the second end effector 252-2, the loaded case blank 111D may be moved forwards onto the second folding platform 165 by a sufficient forward distance to place the trailing bottom flap G between the bases of the items and the surface of the second folding platform 165. This may be assisted by the leading edge of the bottom flap G catching the third ramp 308*r*. This movement may also cause the leading bottom flap F to become angled upwards from the vertical downwards direction and outwards.

In a second movement of the loaded case blank 111D effected by the second cartesian robot 250-2 moving the second end effector 252-2, the loaded case blank 111D may be moved rearwards, back onto the pedestal 140, allowing the leading bottom flap F to drop down. The second folding platform 165 may have been raised sufficiently relative to the pedestal 140 to ensure trailing bottom flap G catches the second ramp 310*r* and is positioned between the bases of the items and the surface of the pedestal 140 during this rearward movement.

In a third movement of the loaded case blank 111D effected by the second cartesian robot 250-2 moving the second end effector 252-2, the loaded case blank 111D may be moved rearwards from the pedestal 140 onto the first folding platform 163, allowing leading bottom flap F to be folded upwards and inwards. The first folding platform 163 may have been lowered sufficiently relative to the pedestal 140 to ensure the trailing bottom flap G catches the first ramp 306*r* and moves between the bases of rearward row(s) of the items 102 and the support surface of the first folding platform 163 during this rearward movement. After this movement, the result is that the bottom flaps F and G have both been moved into an operationally closed supporting position beneath the rows of items 102.

After having the bottom flaps F and G moved to the closed position, the bottom-loading of the collated items 102 into the erected case blank 111C may be considered to be complete such that the loaded case blank 111D is the result. Subsequent movement, by the second cartesian robot 250-2, may act to move the loaded case blank 111D, held by the second end effector 252-2 and containing the collated items 102 in the interior storage space 107, to the output conveyor 170. At the output conveyor 170, the second end effector 252-2 may release the loaded case blank 111D, thereby allowing the output conveyor 170 to move the loaded case blank 111D through further processing.

As the second end effector 252-2 releases the loaded case blank 111D, a kicker arm of the second end effector 252-2 may rotate/articulate, thereby folding the trailing flap H forward, so that the trailing flap H will be subsequently engaged by a generally flat and thin, longitudinally extending compression plate 408 (see FIG. 10).

The output conveyor 170 may be configured to receive the loaded case blank 111D having the leading bottom flap F and the trailing bottom flap G appropriately folded and with the group 122 of items 102 held within the interior storage space 107 defined by the panels A, B, C, Z of the loaded case blank 111D. Next, the remaining bottom flaps (side flaps J and K) may be closed. The closing of the remaining bottom flaps may be shown to be made relatively straightforward, since leading bottom flap F and the trailing bottom flap G are already closed and may be shown to provide support surfaces for holding the items 102 within the interior space 107 of the loaded case blank. In some aspects of the present application, wherein the top flaps were not closed previously, the system 100 of FIG. 1 may be configured to close the top flaps E, I, H, L. Additionally, the loaded case blank 111D may be sealed in a manner that seals the group 122 of items 102 within the interior storage space 107 of the loaded case blank 111D.

As the output conveyor 170 transports the loaded case blank 111D past the compression plate 408 may place the leading top flap E in the closed position. Once both the leading top flap E and the trailing top flap H have been placed in the closed position, these flaps E, H may also be maintained in the closed position by the compression plate 408.

With reference to FIG. 10, the bottom side flaps J, K may be folded using a pair of bottom rails 410, positioned on an underside of the output conveyor platform. The bottom rails 410 may be implemented as two, generally tubular shapes (i.e., an elongated rounded rod or tube). The bottom rails 410 may formed to have two portions, a first portion 410-*r* being a downstream, inwardly angled input portion configured to contact the flaps J, K, and a second portion 410-*p* of the bottom rails 410 being configured in parallel. As the output conveyor 170 transports the loaded case blank 111D along the first portion 410-*r* of the bottom rails 410, the bottom flaps J, K may be moved inward alongside the angle of the first portion 410-*r*. At the nexus of first portion 410-*r* and the second portion 410-*p*, the bottom flaps will be fully closed.

Also in view of FIG. 10, a pair of top flap rails 412 may be employed to fold the top side flaps I, L through the movement of the loaded case blank 111D by the output conveyor 170. The top flap rails 412 may be formed having two portions, a first portion 412-*r* being an angled downstream, inwardly angled input portion configured to contact the flaps I, L, and a second portion 412-*p* of the tubes narrowing to an individual point. As the output conveyor 170 transports the loaded case blank 111D along the first portion 412-*r* of the top flap rails 412, the top flaps I, L may be moved inward alongside the angle of the first portion 412-*r*. At the nexus of the first portion 412-*r* and the second portion 412-*p*, the top flaps I, L will fully close and the case will have traversed outside of the compression plate 408. It should be noted that these folding apparatuses may be able to process a variety of different sized case blanks without adjustment. However, the components of these folding apparatuses may also be mounted to the frame 115 in a manner that allows their positioning to be readily adjusted to accommodate different sized case blanks.

After the top and bottom major flaps have been folded, the loaded case blank 111D may be sealed at both top and bottom ends along their top and longitudinal central flaps joints, using a sealing mechanism (not shown).

The components of the system 100 of FIG. 1, and parts thereof, that are described herein, may be made from generally available materials. For example, some components, or parts thereof, may be made of suitable metals such as steel and/or aluminum, as will be evident to a person skilled in the art, when reading the present disclosure.

Figure 14:
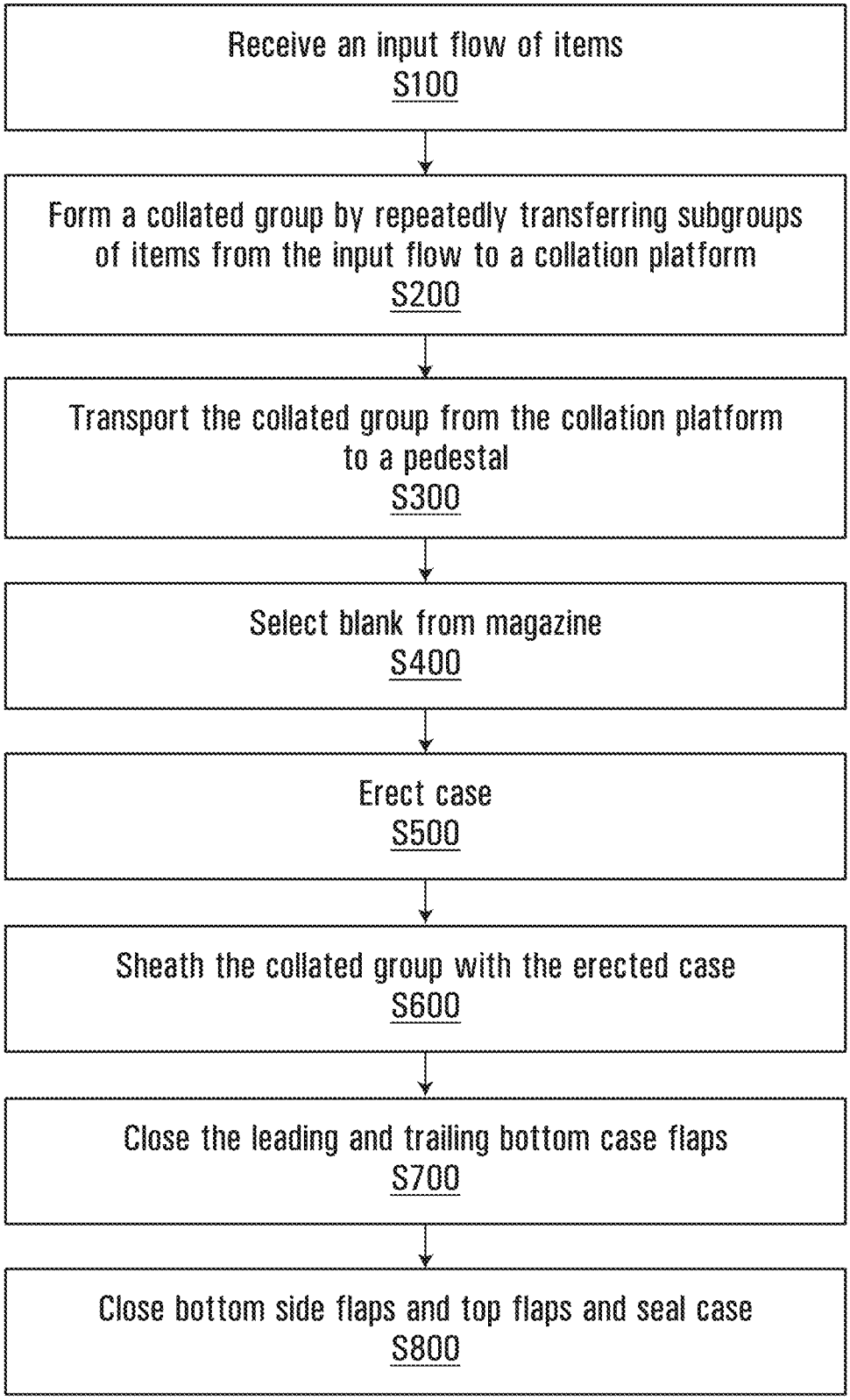
FIG. 14 illustrates, in a flow chart diagram, example steps in a method of filling a case blank with items and closing and sealing the top and bottom ends of the case blank.

FIG. 14 illustrates a flow-chart diagram describing a method M1000 of filling and sealing cases. The method M1000 may be performed by the system 100 of FIG. 1, described hereinbefore.

At step S100, an input flow of items 102 is received, such as from the input/infeed conveyor 104. The input flow of items 102 may be received in a single line.

At step S200, subgroups/rows of items are transferred from the input flow to a collating station to form a collated group. This may be carried out, for example, by the header 116.

At step S300, a collated group is transferred from the collating station to the pedestal 140. The transfer may be done using the header 116. The header 116 may be controlled to slide the group 122 of collated items 102 to the pedestal 140, surrounded on three sides by the fence 124.

At step S400, the first cartesian robot 250-1 may select a knock-down flat case blank 111A from the blank magazine 251.

In step S500, the case is erected. That is the knock-down blank 111A is caused to become the erected case blank 111C, as discussed hereinbefore, the second cartesian robot 250-2 may be moved, under control of the PLC 132, such that the second set of suction cups 313-2, of the second end effector 252-2, may engage the knock-down case blank 111A held by the first end effector 252-1 of the first cartesian robot 250-1.

At step S600, the second cartesian robot 250-2 may act to sheath the collated group with the erected case blank 111C while the fence 124 moves vertically downward. The second cartesian robot 250-2 may hold the erected case blank 111C to approach the collated group 122 of items 102 from above, thereby allowing for the bottom flaps to remain open and providing clearance space for sheathing of the group 122 by the erected case blank 111C.

At step S700, using the second cartesian robot 250-2, the leading bottom flap and the trailing bottom flap may be folded. The second cartesian robot 250-2 may move the loaded case blank 111D forward and rearward in relation to the pedestal 140. The pedestal 140 may be bracketed by platforms, wherein each platform may include a ramp portion and a flat portion. Each of the platforms may be linearly actuated in a vertical axis to allow the platforms to be raised above or lowered below the pedestal 140. Using the method as described with relation to FIG. 13, the bottom flaps may be folded under the individual items 102.

At step S800, the bottom side flaps and all top case flaps may be closed. This may be performed by delivering the case to the output conveyor 170. The output conveyor 170 may be configured to transport the case across a first rail to close the top leading flap and the top trailing flap. A kicker arm may be configured to assist in closing the top trailing minor flap. The top minor flaps may be held in place by a compression plate. Then, top rails and bottom rails may be employed to close the top side flaps and the bottom side flaps. Once closed, the loaded case blank 111D may be fed through a top and bottom case joint sealer, configured to apply a strip of tape or adhesive to the top or bottom of the case along the exposed central flaps joints on the top and bottom of the case.

It is expected that, in some aspects of the present application, the system 100 may be capable of erecting, loading and sealing in the range of approximately 10 case blanks per minute and, possibly, about 15 case blanks per minute or more, depending upon configuration of the specific case blanks, items/group of items and specific components of the system 100 of FIG. 1.

Of course, the above described embodiments are intended to be illustrative only and in no way limiting. The described embodiments of carrying out the invention are susceptible to many modifications of form, arrangement of parts, details and order of operation. The invention, rather, is intended to encompass all such modification within its scope, as defined by the claims.

Selected aspects of the present application may be used in a variety of fields and applications. Other features, modifications and applications of the embodiments described here may be understood by those skilled in the art in view of the disclosure herein.

It will be understood that any range of values herein is intended to specifically include any intermediate value or sub-range within the given range and all such intermediate values and sub-ranges are individually and specifically disclosed.

The word "include" or its variations such as "includes" or "including" will be understood to imply the inclusion of a stated integer or groups of integers but not the exclusion of any other integer or group of integers.

It will also be understood that the word "a" or "an" is intended to mean "one or more" or "at least one" and any singular form is intended to include plurals herein.

It will be further understood that the term "comprise," including any variation thereof, is intended to be open-ended and means "include, but not limited to," unless otherwise specifically indicated to the contrary.

When a list of items is given herein with an "or" before the last item, any one of the listed items or any suitable combination of two or more of the listed items may be selected and used.

It should be appreciated that one or more steps of the embodiment methods provided herein may be performed by corresponding units or modules. For example, data may be transmitted by a transmitting unit or a transmitting module. Data may be received by a receiving unit or a receiving module. Data may be processed by a processing unit or a processing module. The respective units/modules may be hardware, software, or a combination thereof. For instance, one or more of the units/modules may be an integrated circuit, such as field programmable gate arrays (FPGAs) or application-specific integrated circuits (ASICs). It will be appreciated that where the modules are software, they may be retrieved by a processor, in whole or part as needed, individually or together for processing, in single or multiple instances as required, and that the modules themselves may include instructions for further deployment and instantiation.

Although a combination of features is shown in the illustrated embodiments, not all of them need to be combined to realize the benefits of various embodiments of this disclosure. In other words, a system or method designed according to an embodiment of this disclosure will not necessarily include all of the features shown in any one of the Figures or all of the portions schematically shown in the Figures. Moreover, selected features of one example embodiment may be combined with selected features of other example embodiments.

Although this disclosure has been described with reference to illustrative embodiments, this description is not intended to be construed in a limiting sense. Various modifications and combinations of the illustrative embodiments, as well as other embodiments of the disclosure, will be apparent to persons skilled in the art upon reference to the description. It is therefore intended that the appended claims encompass any such modifications or embodiments.

The invention claimed is:

1. A system for loading cases with items, the system comprising:

an item delivery apparatus operable to deliver a plurality of items to a transfer station;

a collation platform operable to support a group of items;

a pedestal operable to support the group of items;

a transfer apparatus operable to:

transfer a plurality of items from the item delivery apparatus at the transfer station, to the collation platform, to form the group of items on the collation platform; and transfer the group of items from the collation platform to the pedestal;

a fence and a fence support apparatus, wherein the fence is arranged to surround, on three sides, the group of items on the pedestal;

a case movement apparatus located proximate the pedestal, the case movement apparatus operable to move an erected case blank in a path that sheaths, with an erected case blank, a group of items located on the pedestal;

a first folding platform and a second folding platform, located on opposite longitudinal sides of the pedestal;

wherein, in operation:

the item delivery apparatus delivers the plurality of items to the transfer station;

the transfer apparatus transfers a plurality of items from the item delivery apparatus at the transfer station, to the collation platform, to form a group of items on the collation platform;

the transfer apparatus transfers the group of items from the collation platform to the pedestal;

the case movement apparatus moves the erected case blank to sheath the group of items located on the pedestal;

the case movement apparatus moves the erected case blank and the group of items held therein, in forward and rearward movements over the first folding platform, the pedestal and the second folding platform to thereby close a trailing bottom flap and a leading bottom flap of the erected case blank; and the fence support apparatus moves the fence vertically downward while the case movement apparatus moves the erected case blank to sheath the group of iterns.

2. The system of claim 1, wherein the case movement apparatus comprises a cartesian robot having an end effector operable to engage with, and release, the erected case blank.

3. The system of claim 2, wherein the cartesian robot having the end effector comprises a second cartesian robot having a second end effector and wherein the system includes a first cartesian robot having a first end effector, wherein the first end effector is operable to engage a flattened case blank and cooperate with the second cartesian robot to open the flattened case blank into the erected case blank.

4. The system of claim 1, wherein the first folding platform comprises a ramp portion at a proximal side to the pedestal and a flat portion at a distal side of the pedestal.

5. The system of claim 1, wherein the second folding platform comprises a ramp portion at a proximal side to the pedestal and a flat portion at a distal side of the pedestal.

6. The system of claim 1, wherein, in operation, the case movement apparatus moves the erected case blank to a flap folding apparatus, the flap folding apparatus being operable to close the trailing bottom flap and the leading bottom flap of the erected case blank.

7. The system of claim 6, wherein the erected case blank has a plurality of top flaps and the flap folding apparatus is operable to close the plurality of top flaps.

* * * * *